United States Patent [19]

Bowman et al.

[11] Patent Number: 4,747,739

[45] Date of Patent: May 31, 1988

[54] INGOT MOLD AND METHOD

[76] Inventors: Harold M. Bowman, 18867 N. Valley Dr., Fairview Park, Ohio 44126; Thomas P. Kicher, 1083 Hillrock Dr., South Euclid, Ohio 44121

[21] Appl. No.: 918,571

[22] Filed: Oct. 14, 1986

Related U.S. Application Data

[60] Continuation of Ser. No. 520,135, Aug. 3, 1983, abandoned, which is a division of Ser. No. 266,382, May 22, 1981, Pat. No. 4,416,440, which is a continuation-in-part of Ser. No. 78,447, Sep. 24, 1979, Pat. No. 4,358,084, which is a continuation-in-part of Ser. No. 3,093, Jan. 15, 1979, Pat. No. 4,269,385, which is a continuation-in-part of Ser. No. 669,650, Jun. 24, 1976, abandoned, which is a continuation-in-part of Ser. No. 600,060, Jul. 29, 1975, abandoned.

[51] Int. Cl.[4] ..... F16B 33/00

[52] U.S. Cl. ..... 411/368; 411/544; 249/174

[58] Field of Search ..... 411/10,11, 368, 388, 411/389, 544; 267/162, 182; 249/174

[56] References Cited

U.S. PATENT DOCUMENTS

| | | | |
|---|---|---|---|
| 158,696 | 1/1875 | Foster et al. . | |
| 354,742 | 12/1886 | Sabold . | |
| 496,736 | 5/1893 | Hodgson . | |
| 504,131 | 8/1893 | Mallasee | 249/174 |
| 1,224,277 | 5/1917 | Clarke . | |
| 1,438,677 | 12/1922 | Weymerskirch | 249/82 |
| 1,491,881 | 4/1924 | Perry | 249/174 |
| 1,584,954 | 5/1926 | Lee et al. . | |
| 2,028,243 | 1/1936 | Perry et al. | 249/174 |
| 2,071,906 | 2/1937 | Stevens | 249/174 |
| 2,162,719 | 6/1939 | Hay | 267/162 |
| 2,387,266 | 10/1945 | Holland | 267/162 |
| 3,856,242 | 12/1974 | Cook | 267/162 |
| 3,927,855 | 12/1975 | Kleinhagauer . | |
| 3,992,974 | 11/1976 | Miki et al. | 411/544 |
| 4,078,762 | 3/1978 | Kocks | 249/174 |
| 4,165,863 | 8/1979 | Schreyer | 267/162 |
| 4,269,385 | 5/1981 | Bowman . | |

FOREIGN PATENT DOCUMENTS

| | | | |
|---|---|---|---|
| 756253 | 11/1970 | Belgium . | |
| 630871 | 6/1936 | Fed. Rep. of Germany | 411/544 |
| 1919710 | 11/1970 | Fed. Rep. of Germany . | |
| 2353449 | 1/1975 | Fed. Rep. of Germany . | |
| 2405598 | 8/1975 | Fed. Rep. of Germany . | |
| 966058 | 3/1950 | France | 249/174 |
| 566180 | 7/1975 | Switzerland . | |
| 13446 | of 1900 | United Kingdom . | |
| 16905 | of 1909 | United Kingdom | 267/162 |
| 1099472 | 1/1968 | United Kingdom | 411/11 |
| 1240893 | 7/1971 | United Kingdom . | |
| 1380726 | 1/1975 | United Kingdom . | |
| 1464075 | 2/1977 | United Kingdom . | |
| 253305 | 2/1970 | U.S.S.R. | 249/174 |
| 588057 | 2/1978 | U.S.S.R. | 249/174 |

*Primary Examiner*—Neill Wilson

*Attorney, Agent, or Firm*—Baldwin, Edan & Fetzer

[57] ABSTRACT

An ingot mold provided with means affording stress relief thereto for the ingot pouring operation, while maintaining the mold in condition to aid in preventing metal leakage therefrom during the ingot pouring operation and subsequent cooling of the ingot, and providing mold wall support for the ingot until its skin has sufficient structural integrity to support the molten interior of the ingot, and a mold which can be recycled for use in a faster manner as compared to heretofore utilized solid or one-piece type ingot molds. In certain embodiments, the mold is formed of a plurality of completely separate and individual side wall sections defining at least the side periphery of a mold cavity, together with coupling means connecting the wall sections together. The coupling means provide for expansion and contraction of the mold sections relative to one another during the pouring of molten metal into the mold, and the resultant heating and subsequent cooling thereof. At least certain of such coupling means comprises adjustable spring means able to be preloaded a predetermined extent prior to the pouring operation, and thus providing for predetermined preloading of the openable and closeable junctures between the mold sections. In other embodiments, the mold may be of a generally one-piece affair, but having said wall sections with junctures openable and closeable, together with the aforementioned coupling means, including preloadable spring means, for automatic compensation for expansion and contraction of the mold during the pouring and ingot producing cycles thereof in a manner to provide stress relief to the mold. A novel method for production of metal ingots is also disclosed.

6 Claims, 19 Drawing Sheets

0-TIME, MINUTES
FLUX BY RADIATION AFTER 4.61 MINUTES (0.00740 = 7)
RADIATION FLUX
0.92
1.85
4.61
9.22
18.44
36.88
0 = (T (r,t) - T₀) / (Tm - T₀)
TEMPERATURE °F
2815
2438
2180
9104
1628
1352
1075
799
603
326
50
276.5°F
RADIUS
0
1.37"
17.78"
9.58"
27.36"

P = CLAMPING FORCE

2 P cos45° = COMPONENT OF CLAMPING FORCE PROVIDING RESTRAINT AGAINST BEAM BENDING

NON-COMPRESSED CONDITION
BEFORE PRELOADING

INGOT MOLD AND METHOD

This is a continuation patent application of U.S. Ser. No. 520,135 filed Aug. 3, 1983, now abandoned, which is a division of application Ser. No. 266,382 filed May 22, 1981 (now U.S. Pat. No. 4,416,440 dated Nov. 22, 1983) which in turn is a continuation-in-part patent application of U.S. patent application of Harold M. Bowman, Ser. No. 78,447 filed Sept. 24, 1979 (now U.S. Pat. No. 4,358,084), which is a continuation-in-part of U.S. patent application Ser. No. 3,093 filed Jan. 15, 1979 (now U.S. Pat. No. 4,269,385), which in turn is a continuation-in-part patent application of Ser. No. 669,650 filed June 24, 1976 (now abandoned), which in turn is a continuation-in-part patent application of Ser. No. 600,060, filed July 29, 1975 (now abandoned).

This invention relates to ingot molds and more particularly to reusable or recycleable ingot molds of improved construction and functionability. Certain of the embodiments show sectional ingot molds formed of a plurality of individual and completely separate side wall sections, which when assembled, define a mold cavity, with means to connect or couple the side wall sections together to provide automatic compensation for expansion and retraction of the mold side wall sections when molten metal is poured into the ingot mold and during the resultant heating and subsequent cooling thereof. During the pouring operation of molten metal into the mold and the formation of the ingot, the connecting or coupling means allow for expeditious and controlled expansion of the mold sections, with respect to one another, while aiding in sealing the respective mold sections from leakage of molten metal during the pouring and subsequent solidification of the ingot in the mold. At least certain of the coupling means includes disc spring means operable for preloading to a predetermined extent. In certain embodiments, the molds are of generally one-piece construction, but having openable and closeable junctures therein providing for the aforementioned automatic expansion and contraction of the mold during pouring of the ingot, the solidification thereof and subsequent cooling. A novel method for the production of ingots is also disclosed.

BACKGROUND OF THE INVENTION

Sectional ingot molds are known in the prior art. U.S. Pat. No. 496,736 issued May 2, 1893 to C. Hodgson and U.S. Pat. No. 1,224,277 issued May 1, 1917 to F. Clarke, are examples of prior art sectional mold constructions. U.S. Pat. Nos. 354,742 issued Dec. 21, 1886 to J. Sabold and British Pat. No. 13446 of A. D. 1900 in the name of Stephen Appleby, et al and entitled "Improvements in or Connected with Ingot Molds", disclose sectional mold arrangements embodying means for relieving stress on the fastening bolts thereof due to the expansion of the molten metal. However, such prior art sectional molds have not alway been satisfactory, due at least in part to oftentimes leakage of molten metal occurring between the mold sections during the pouring of the molten metal into the mold cavity and subsequent solidification of the metal, or due to the complexity and/or costs of such arrangements.

H. S. Lee and Amos E. Chaffee in U.S. Pat. No. 1,584,954 issued May 18, 1926 identified Permanent Mold Distortion and its attempted control by using thermally responsive insert elements to effect control of a permanent mold leaking molten metal along the parting line and to avert distortion or a bowing action of the mold by placing higher or lower coefficient of expansion metals in position in the mold to resist the inward or outward movement of the mold thus directly effecting the casting being formed and produced by the permanent mold.

U.S. Pat. No. 158,696 to Foster et al discloses a sectional mold in conjunction with spring-loaded bolts to provide for lateral expansion of the mold sections relative to one another during the expansive force of the molten metal poured into the mold.

In the aforementioned U.S. Ser. Nos. 3,093 and 78,447 of applicant Bowman, there is disclosed sectional ingot molds having fastener means for connecting mold wall sections together to form a mold cavity, and providing for automatic compensation, including a delayed faster rate of expansion for reducing stresses, and also including memory, to allow for expansion and retraction of the mold assembly sections when molten metal is poured into the ingot mold and during the subsequent cooling of the ingot, while aiding in sealing the mold sections from leakage of molten metal during the pouring and subsequent cooling of the ingot in the mold. The prior art cited in said U.S. Bowman applications is incorporated herein by reference.

In British Pat. No. 1,380,726, published Jan. 15, 1975 there is disclosed a sectional ingot mold having separate corner members adapted to mate into concave recesses in the mold wall sections for attempting to relieve the stress resulting from the temperature gradient existing across the side wall sections upon pouring of molten metal into the mold. A strap extending around the wall sections serves to hold the latter in assembled relation in one embodiment, and coiled spring strips at the mold corners exerting constant force are utilized in another embodiment.

British Pat. No. 1,464,075 published Feb. 9, 1977 discloses a liquid cooled chill-casting sectional mold which includes split clamping rings holding the mold parts together, with Belleville type disc spring means acting on the extremities of the split clamps, for pressing the extremities toward one another. However, there are no teachings concerning pre-loading or what such preloading should accomplish.

British Pat. No. 1,240,893 published July 28, 1971 discloses a slab mold having a bottom wall movable upwardly relative to the side walls of the mold at a rate which will exert a pressure on the metal equal or greater than the ferrostatic pressure, thereby attempting to prevent a rupture of the skin of a solidifying slab and escape of molten metal from the slab's interior.

None of the prior art molds, in applicants' opinion, is optimumly operable when exposed to thermal, elastic and ferrostatic stresses resulting from the pouring of molten metal into a sectional mold in the formation of ingots, such as for instance steel ingots, in the manner of applicants' arrangement.

SUMMARY OF THE INVENTION

The present invention provides novel ingot mold constructions wherein the mold is provided with juncture means affording stress relief thereto during the ingot forming operation, while effectively aiding in maintaining the mold in condition to prevent metal leakage therefrom during the pouring operation and subsequent cooling of the ingot, and providing for the production of an ingot having an ingot skin with sufficient structural integrity to support the molten interior of the poured ingot, and a mold which can be recycled for use in ingot production in a faster manner as compared to heretofore used one-piece ingot mold structures. In this respect, the coupling means coacting with the openable and closeable junctures of the side wall portions defining the mold cavity comprises adjustable spring means which are preloaded a predetermined extent prior to the molten metal pouring operation. In certain embodiments, the mold is formed of a plurality of separate side wall sections defining at least the side periphery of the mold cavity, while in other embodiments, the mold walls are of a generally one-piece affair having juncture sections or slit portions which are openable and closeable during the casting or molding process for releasing stresses in the mold. The aforementioned spring means preferably comprises Belleville type springs.

Accordingly, an object of the invention is to provide an ingot mold with openable and closeable juncture means therein, with coupling means to at least initally hold the junctures closed to form a mold cavity for pouring molten metal thereinto; the coupling means in conjunction with the junctures provides for automatic compensation for expansion and retraction of the mold, when molten metal is poured into the mold, and during subsequent cooling of the ingot, with resulting action of relatively quicker heat dissipation from the mold.

A still further object of the invention is to provide a mold in accordance with the above which aids in relieving "as cast" stress surface cracks in the produced ingot, and metal leakage from the resulting ingot during the formation thereof.

A still further object of the invention is to provide an ingot mold which has laterally projecting flanged sections on the mold at openable and closeable junctures therein, adapted for receiving means coupling the mold juncture sections together into an integral and an initially closed mold defining an ingot mold cavity, and with said coupling means possessing memory and automatically compensating for expansion and retraction of the mold assembly during the ingot forming operation in the mold assembly, and resultant heating and subsequent cooling and solidification of the formed ingot, and wherein at least certain of the coupling means includes adjustable spring coupling means adapted to preload to predetermined extent the mold junctures in closed condition prior to the pouring operation on the mold, and preventing leakage of molten metal at the mold junctures and providing for formation of an ingot skin having sufficient structure integrity to support the molten interior of the poured ingot, while providing for predetermined release of stresses due to the thermal moments in the mold sections.

Other objects and advantages of the invention will be apparent from the following description taken in conjunction with the accompanying drawings, wherein:

BRIEF DESCRIPTION OF THE DRAWINGS

FIG. 3 is an enlarged sectional view taken generally along the plane of line 3—3 of FIG. 1;

FIG. 6 is a perspective view of the side wall section of FIG. 5, looking at the opposite or exterior side thereof;

FIG. 10 is a finite difference grid for the heat transfer model illustrated in FIGS. 9, 9A;

FIG. 19 illustrate the Belleville spring with the aforementioned "flats";

DESCRIPTION OF PREFERRED EMBODIMENTS

Figure 1:
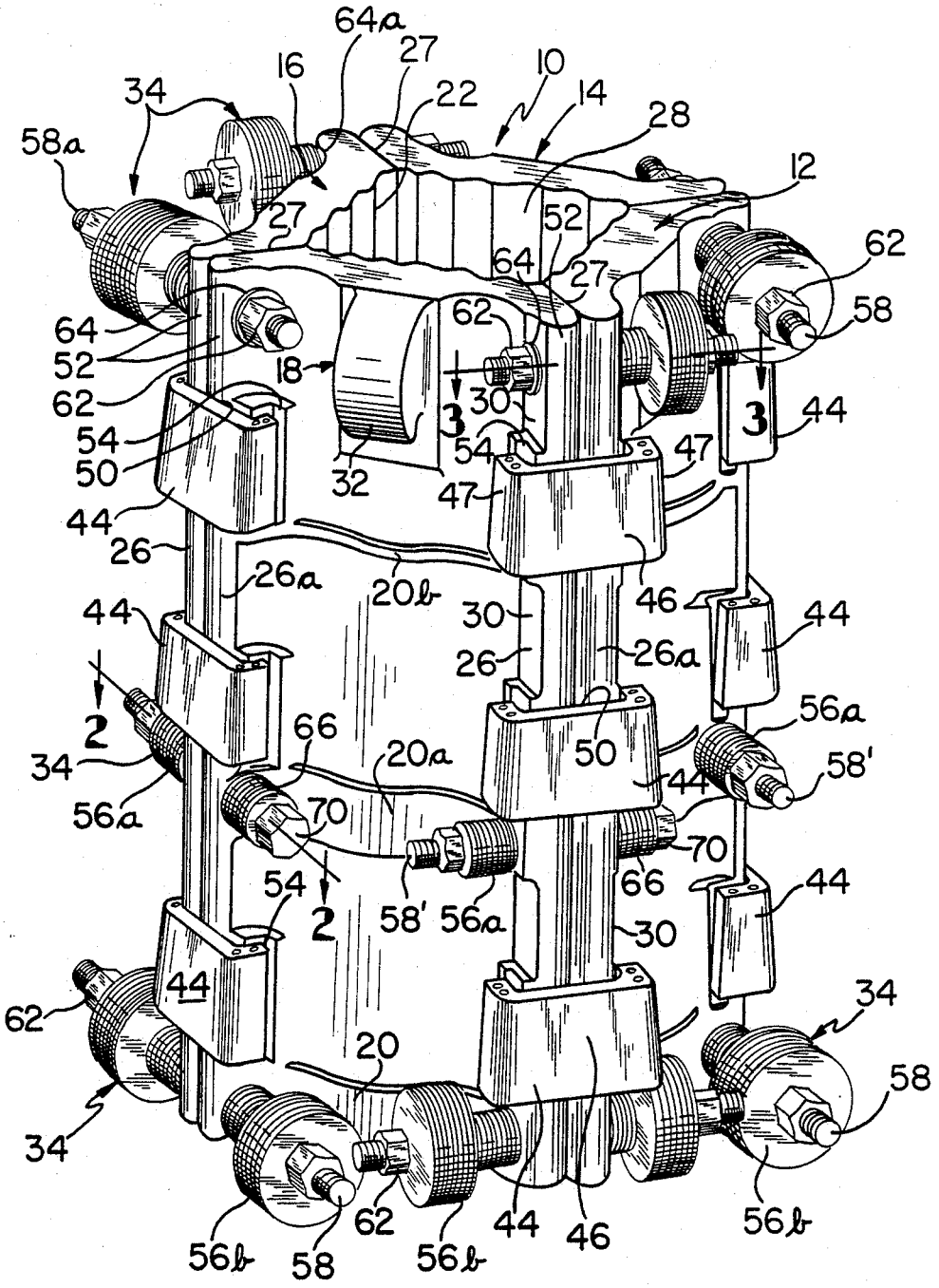
FIG. 1 is a perspective view of a sectional ingot mold constructed in accordance with an embodiment of the invention.

Referring now again to the drawings and particularly to FIGS. 1, 2, 2A, and 3 there is illustrated an ingot mold 10. Such ingot mold in the embodiment illustrated, comprises separate but generally identical mold sections 12, 14, 16 and 18 coupled together. Each of sections 12, 14, 16 and 18 may have transverse rib sections 20, 20*a*, 20*b* on the exterior thereof, and generally wave-like or sinuous-like interior surfaces 22. Surfaces 22 are adapted to aid in stress relief in the ingot as cast; and aid in reducing external skin cracks in the ingot, as well as aiding in preventing leakage of molten metal from the interior of the newly poured ingot or from the mold assembly cavity.

The side ends of each mold section 12, 14, 16 and 18 is provided with laterally projecting flanges or lugs 26, 26*a*. Each of the lugs or flanges 26, 26*a* is adapted for abutting engagement as at 27 with the confronting flange or lug of the adjacent mold section, to define the ingot mold cavity 28. Flanges or lugs 26, 26*a* preferably extend the full height of the respective mold section, as illustrated, and embody vertically spaced sections 30 of reduced size or thickness for a purpose to be hereinafter set forth. While the interior surface of each mold section is illustrated as having a wave-like or sinuous configuration, such interior surface can be generally smooth surfaced.

As illustrated, the mold 10 may be open from vertical end to end thereof, and during pouring of an ingot, may be set for instance in a sand area or preferably on a metal base plate or "stool" (not shown) for furnishing the bottom for the mold. The mold sections may be formed of any suitable material, but aforementioned Class 20 gray cast iron, or blast furnace iron may be utilized. It will be seen that in the event of breakage or the wearing out of one mold section, that another section can be readily substituted for the broken or worn out section, so that the entire mold does not have to be replaced. Moreover, the sectional construction with the coupling or fastener means 34, provides for expansion and contraction of the mold sections during heating and cooling, and eliminates stresses and strains found in one-piece or unitary molds, and as will be hereinafter described in detail.

Lugs or projections 32 may be provided at the upper end portion of certain of the mold sections of the respective mold, such as for instance mold sections 14 and 18, and are adapted for lifting purposes so that once the ingot has adequately solidified, the mold can be raised as for instance by a crane or the like, utilizing a lift chain about the lugs 32, and then shaken, to shake or slide the ingot out of the mold. If the mold is of open bottom construction, the ingot is adapted to slide out of the bottom of the mold. If it turns out that the solidified ingot cannot be dislodged from the mold, then a hydraulic pusher ram may be used, or of course the mold sections could be opened after sufficient cooling, by loosening of the coupling means 34 holding the mold sections together to separate the mold sections amd provide for removal of the ingot.

Mold sections 12, 14, 16 and 18 of the FIG. 1 mold may be generally similar to the ingot mold sections illustrated in FIGS. 31–29 inclusive of applicant's aforementioned copending patent application Ser. No. 78,447, and reference may be made thereto and the associated description therefor for a more detailed discussion of the structural arrangement of such mold sections.

The aforementioned coupling or fastener means 34 in this FIG. 1 ingot mold embodiment has been illustrated as including clip members 44 of generally C-shaped configuration in plan (FIG. 1) which coact with or between the adjacent flange portions 26, 26*a* for clamping the mold sections together into an integral mold assembly. Each clip 44 is formed of metal and comprises a body portion 46, and arm portions 47 projecting laterally from said body portion in generally converging relation with respect to one another, with the arm portions being adapted to clasp the adjacent flange or lug of the mold section therebetween in coupling relation.

Body portion 46 of each clip is preferably provided with a generally concave interior surface 50 adapted to face in spaced relation the confronting end faces 52 of the adjacent flanges of the mold assembly. The clips are inserted into the aforementioned reduced size section 30 of the flanges, with the arm portions being readily received in encompassing relation to the reduced size flange sections 30 and then the clips are moved or driven vertically into tight coacting relation with the tapered pockets or cam surfaces 54 on the wider portions of the flanges, for clamping the mold sections tightly together at the clip locations. The vertical gripping faces of the clips are tapered for facilitating their movement from the reduced size sections 30 of the flanges into tight camming coaction with the cam means 54 on the wider portions of the coacting flanges. Reference may be made particularly to FIGS. 27 to 30 of the aforementioned copending application Ser. No. 78,447 for a more detailed discussion of the clips 44 and their coaction with the cam pockets on the mold section, and such disclosure is incorporated herein by reference.

The clips 44 may be formed of stabilized austenitic stainless steel. A suitable type of stainless steel material for use for the clips is that known as RA-330 stainless, purchaseable from Rolled Alloys, Inc. of Detroit, Mich.

and described in its present bulletin identified as No. 107. Stabilized austenitic stainless is characterized by having a relatively high nickel content, with the stainless steel material having relatively low rates of thermal conductivity as compared to, for instance, carbon steels, and possessing elasticity to return back to its original condition after it has been heated up to a relatively high temperature (e.g. 220° F.). Reference may be made to aforementioned Ser. Nos. 3,093 and 78,447 for a detailed discussion of suitable clip structure and such is incorporated herein by reference. In other words, this material has "memory" which causes it to return to substantially its original condition after cooling thereof.

"Memory" as used herein, and in the hereafter set forth claims, means the ability of the fastener means material of the mold assembly to return to substantially its original preheated size condition and to retain its important physical properties, after undergoing thermal stress and other stress (e.g. ferrostatic stress) at temperature to which the fastener means is subjected upon the pouring of molten metal into the mold cavity to form an ingot, and the resultant heating and subsequent cooling thereof.

It is well known in the ingot mold art to have "big ended" molds wherein one end of the mold is of a larger cross sectional area as compared to the other end thereof, and it is common practice to pour ingot molds with either the "big end" up or the "big end" down. Also "bottle top" ingot molds, "open bottom" ingot molds, "closed bottom" ingot molds, and "plug bottom" ingot molds are well known in the art, with such molds having various cross-sections of "flat sided", "cambered", "rippled", "corrugated" and/or "fluted" interior surface configurations, each traversing partially or completely the length of the mold side wall. Moreover, the use of "hot tops" are well known in the ingot mold art, in order to aid in preventing piping and the like in a produced ingot. The inventions of the present application may be useable in conjunction with any or all of the above prior art structures. A typical chemical analysis of aforementioned blast furnace iron for producing the mold side well sections 12, 14, 16, and 18 may be as follows:

| | Range |
|---|---|
| Phosphates | .15% to .25% |
| Sulphur | .025% to .045% |
| Silicone | 1.15% to 1.45% |
| Magnesium | .30% to .50% |
| Carbon | 3.5% to 4.5% |

In accordance with the present invention, there is provided adjacent both the upper and lower ends of the vertically oriented mold assembly 10 as well as intermediate such upper and lower ends, another form of fastener coupling mens 34, for releasably holding the mold sections together. In the embodiment illustrated such fastener means comprises disc spring fastener assembly 56 coacting between adjacent mold sections (e.g. 12 and 18) at the upper end of the mold assembly, a disc spring fastener assembly **56*a*, coacting between the adjacent mold sections just below the approximate middle of the mold assembly, and a disc spring fastener assembly 56*b*** coacting between the adjacent mold sections in the vicinity of the lower end of the mold assembly.

Each fastener assembly 56 (FIG. 3) comprises a bolt 58 threaded as at **58*a* preferably at both ends thereof, with such bolt extending through aligned openings 60 in the adjacent flanges 26 and 26*a* of adjacent mold sections. A threaded nut 62 coacts with the respective threaded end of the bolt 58, and solid flat washer members 64, 64*a* provide a flat abutment surface for the disc srings 66, 66*a* of the fastener assembly. The springs 66, 66*a* are preferably Belleville-type disc springs and are preferably stacked in the manner illustrated in FIG. 3**.

The bottom spring assembly **56*b* for the ingot mold is generally identical to the assembly 56 illustrated in FIG. 3, except that it also includes an assembly of disc springs on the other end of the bolt, and as is clearly shown in FIG. 1 of the drawings. The bolt 58 in assembly 58*b* is thus longer as compared to the bolt in assembly 56. The bolts 58 are preferably high strength steel bolts (identified in the trade as B7 bolts) the particulars of which will be hereinafter discussed in greater detail. In the assemblies 56, 56*b***, the bolts are preferably threaded at both ends thereof as illustrated and coact with a respective nut.

Figure 2:
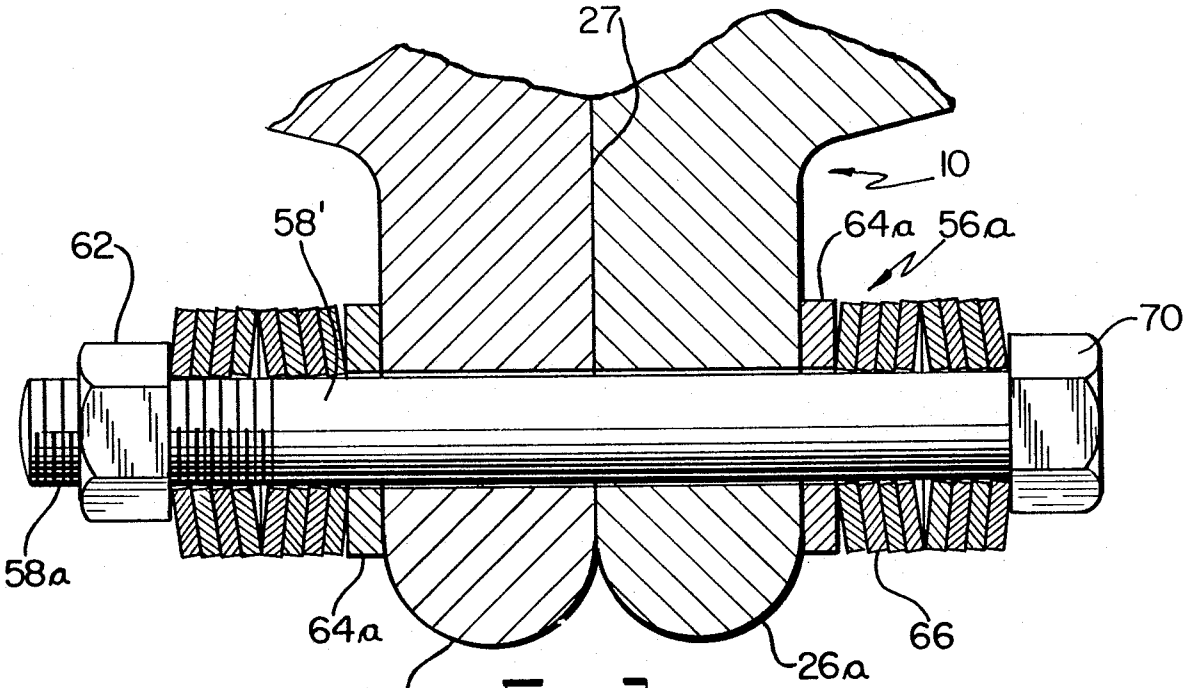
FIG. 2 is an enlarged sectional view taken generally along the plane of line 2—2 of FIG. 1, looking in the directions of the arrows.
Figure 2A:
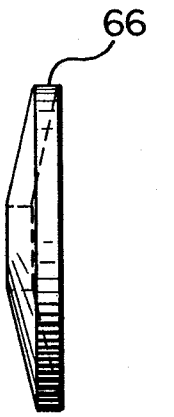
FIG. 2A is a side elevational view of one of the Belleville spring elements of FIG. 2.
Figure 19:
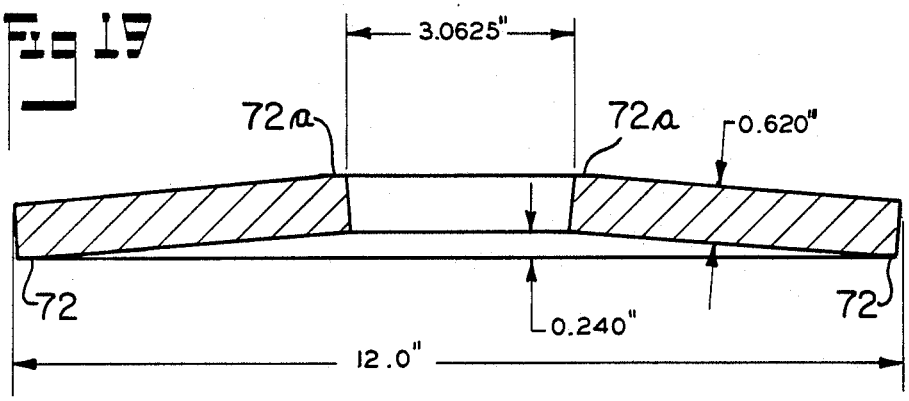
FIG. 19 is a transverse sectional view of one of the larger Belleville springs utilized in certain of the adjustable fastener means embodied in the ingot mold of the invention.
Figure 20:
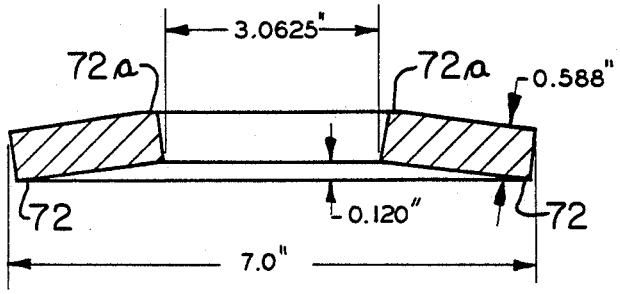
FIG. 20 is a transverse sectional view of one of the smaller Belleville springs utilized in the adjustable fastener means embodied in the ingot mold of the invention.

In the intermediate fastener assembly **56*a* illustrated in FIGS. 1 and 2, the bolt 58' is headed as at 70 with the associated nut 62 coacting with the threaded end of the bolt. As can be best seen in the enlarged, sectional view of the Belleville springs illustrated in FIGS. 19 and 20, the exterior corners of the springs are preferably "broken" or flattened as at 72, while the interior corners which coact with an adjacent spring are likewise preferably "broken" or flattened as at 72*a*, which improves the transmission of force from one spring to the adjacent spring, as will be hereinafter discussed in greater detail. Spring assemblies 56, 56*a*, 56*b*** are adapted for preloading to predetermined extent prior to pouring the ingot for maintaining the juncture surfaces of the mold sections in generally abutting condition until completion of the filling of the mold cavity to a predetermined extent with molten metal and the formation of an ingot skin on the poured ingot having sufficient structural integrity to support the molten interior of the poured ingot.

Figure 4:
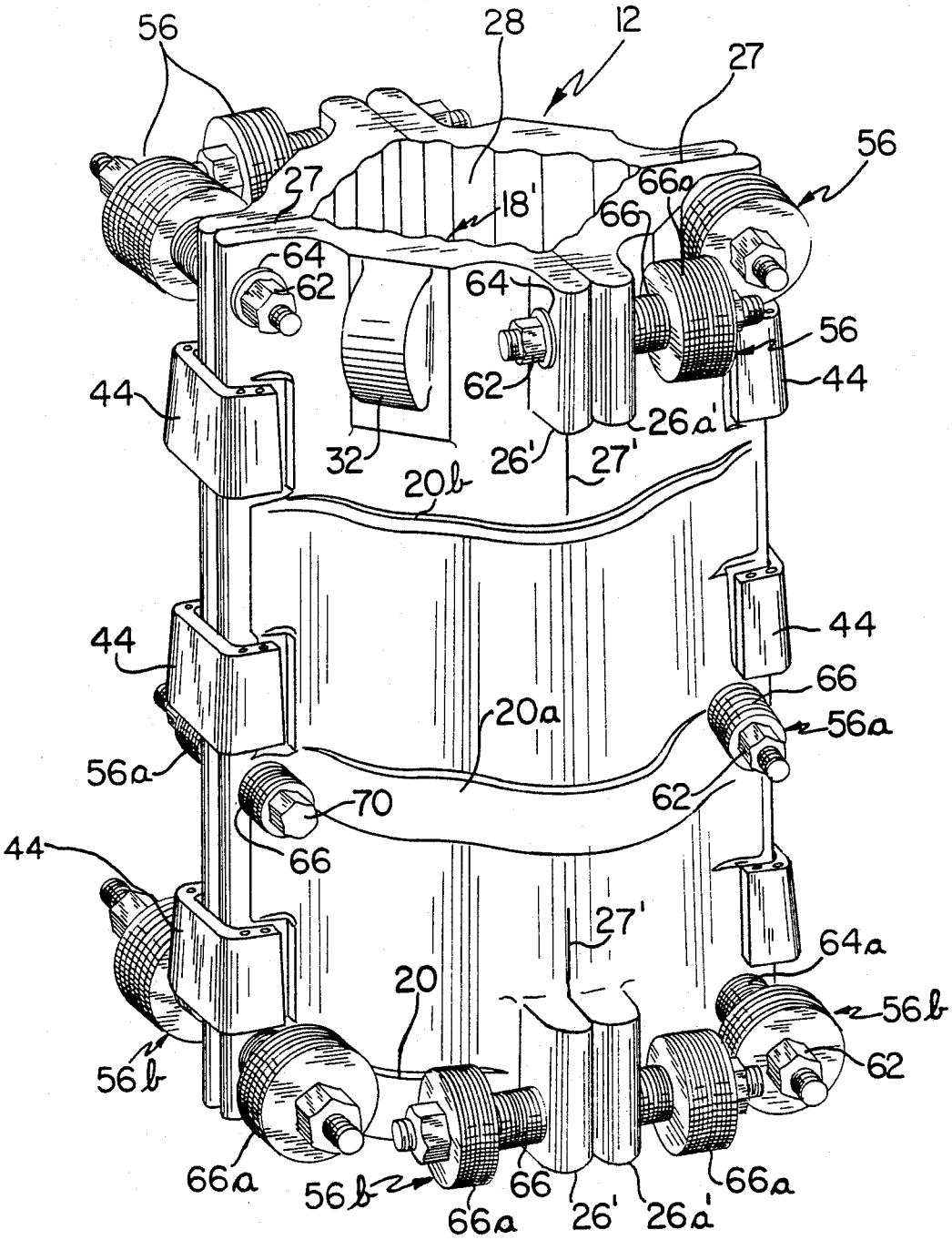
FIG. 4 is a perspective view of another embodiment of a sectional ingot mold embodying the invention.

Referring now to FIG. 4 there is illustrated a sectional ingot mold comprised of only two mold side wall sections instead of the four sections illustrated in FIG. 1. Such mold sections 12', 18' are joined to one another along generally vertically extending juncture surfaces 27 in a similar manner as in the first described embodiment and the pair of mold sections are maintained in assembled relationship by fastener clips 44 and spring fastener assemblies of 56, **56*a* and 56*b* in a generally similar manner as in the first described embodiment. In this embodiment, each of the mold sections 12', 18' also includes a vertically extending openable juncture or slit 27' adjacent top and bottom ends of the respective mold section, with such openable juncture surfaces 27' including flange segments 26' 26*a'* with each adjacent pair of flange segments coacting with a respective fastener assembly 56, 56*b* in a generally similar manner as for the full length juncture surfaces 27 of the assembled mold. The preloading of the spring fastener assemblies in the mold assembly of FIG. 4** is generally the same as aforedescribed in conjunction with the first described embodiment of mold assembly.

Figure 5:
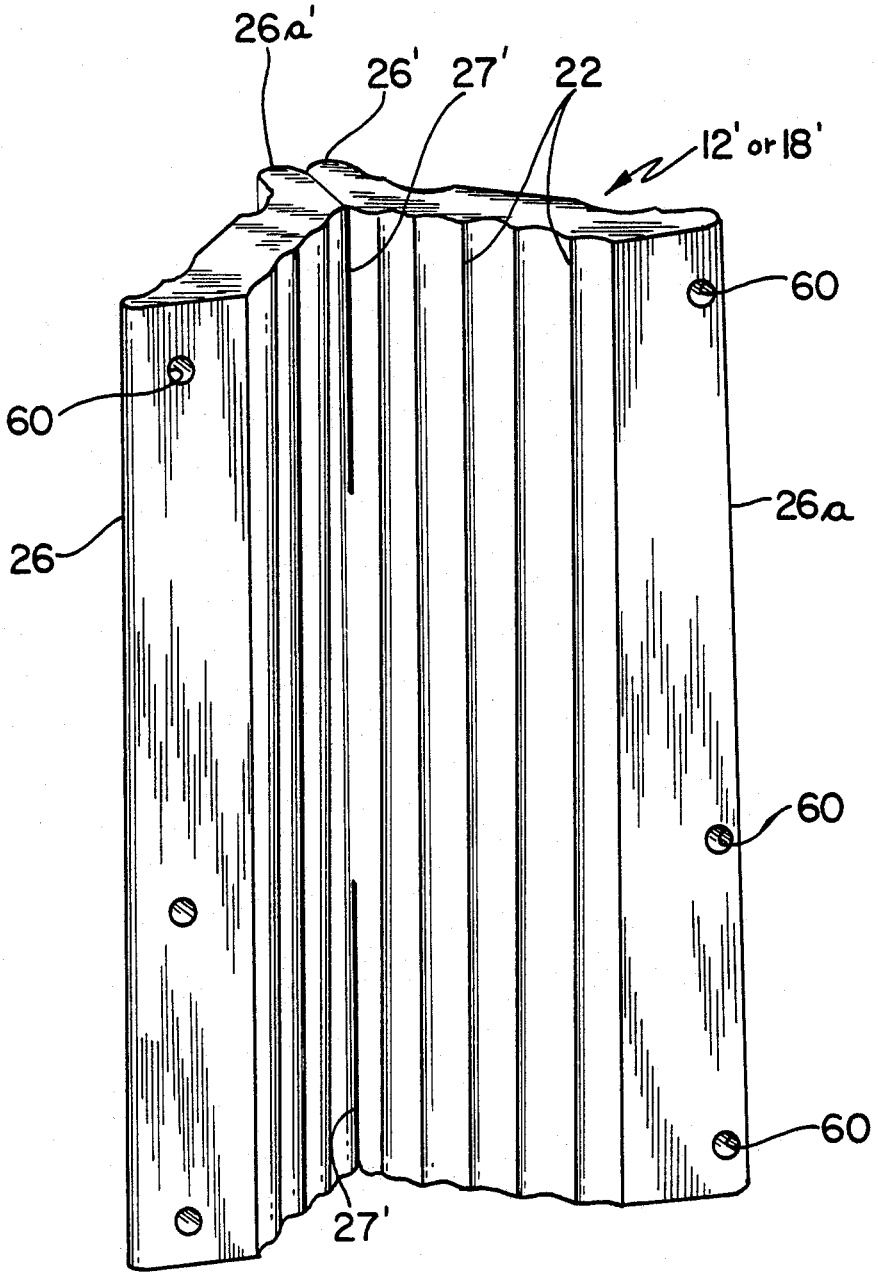
FIG. 5 is a perspective view of one side wall section of the FIG. 4 mold, looking at the interior of the side wall section.
Figure 5:
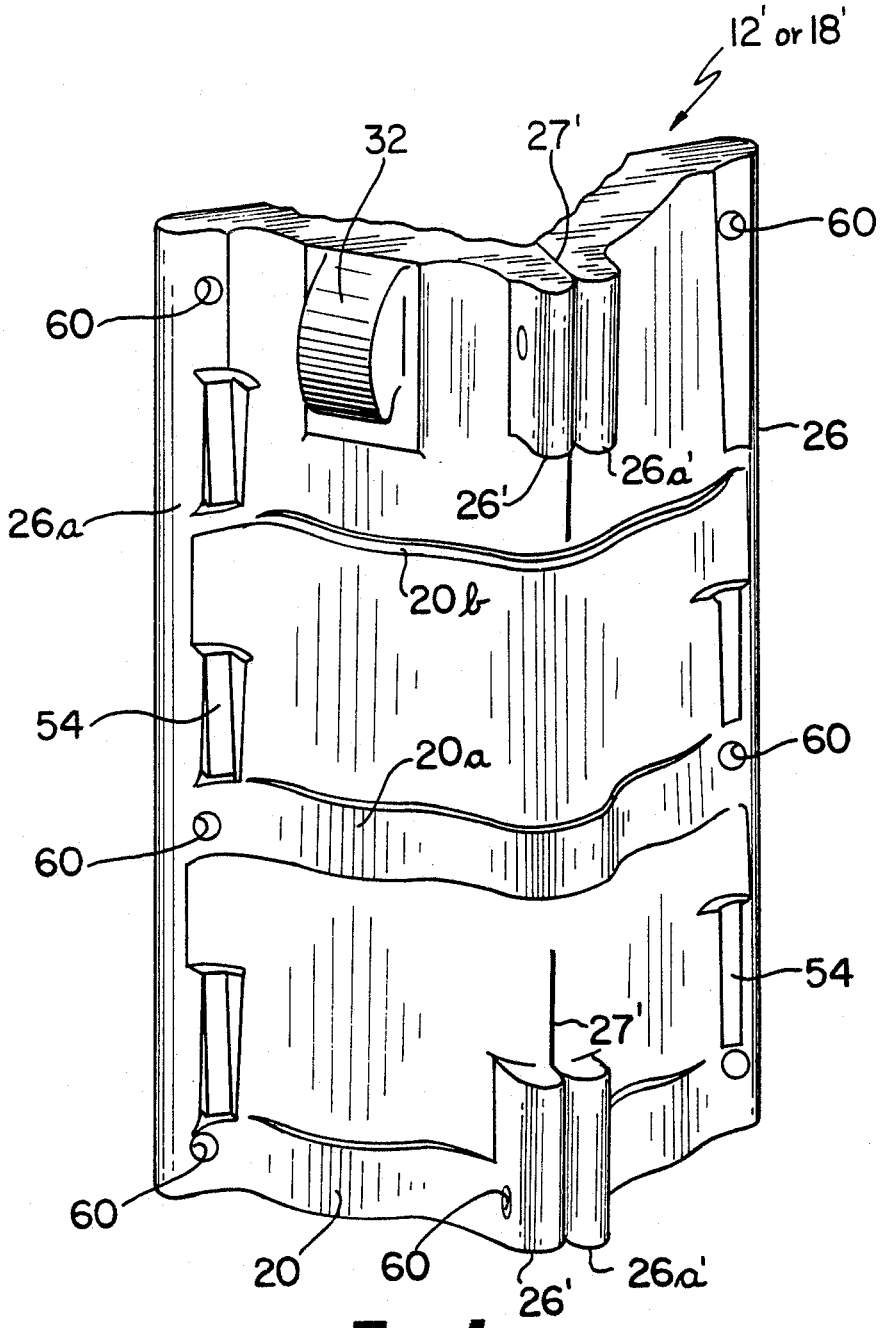
Figure 7:
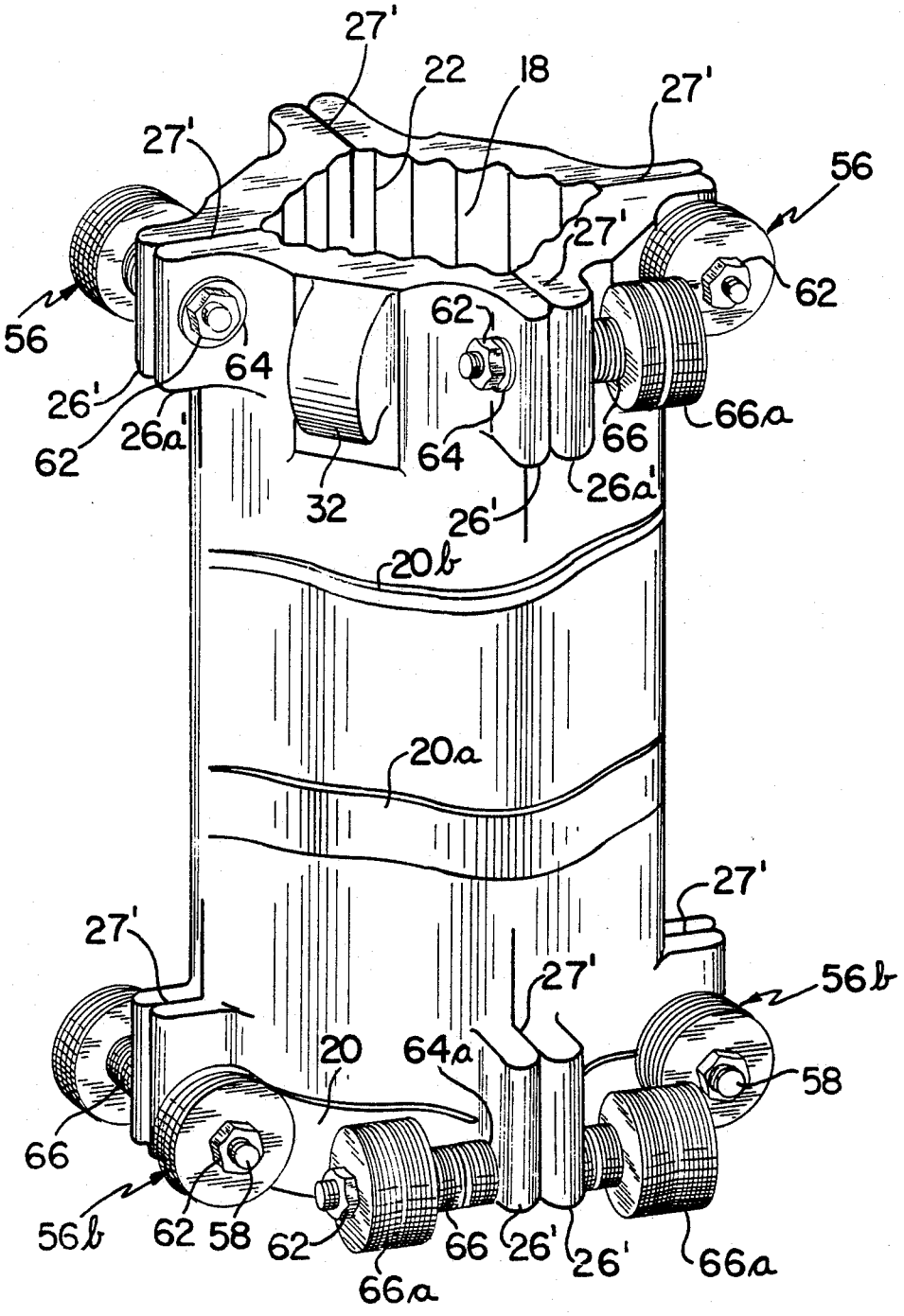

FIG. 5 illustrates a view from the interior of one of the mold sections 12' or 18', showing the openable juncture surfaces 27' thereof extending from both the bottom and top extremities of the respective mold section 12' or 18', and FIG. 6 illustrates one of the mold sections 12' or 18' without the fastener coupling means associated therewith.

Figure 7:
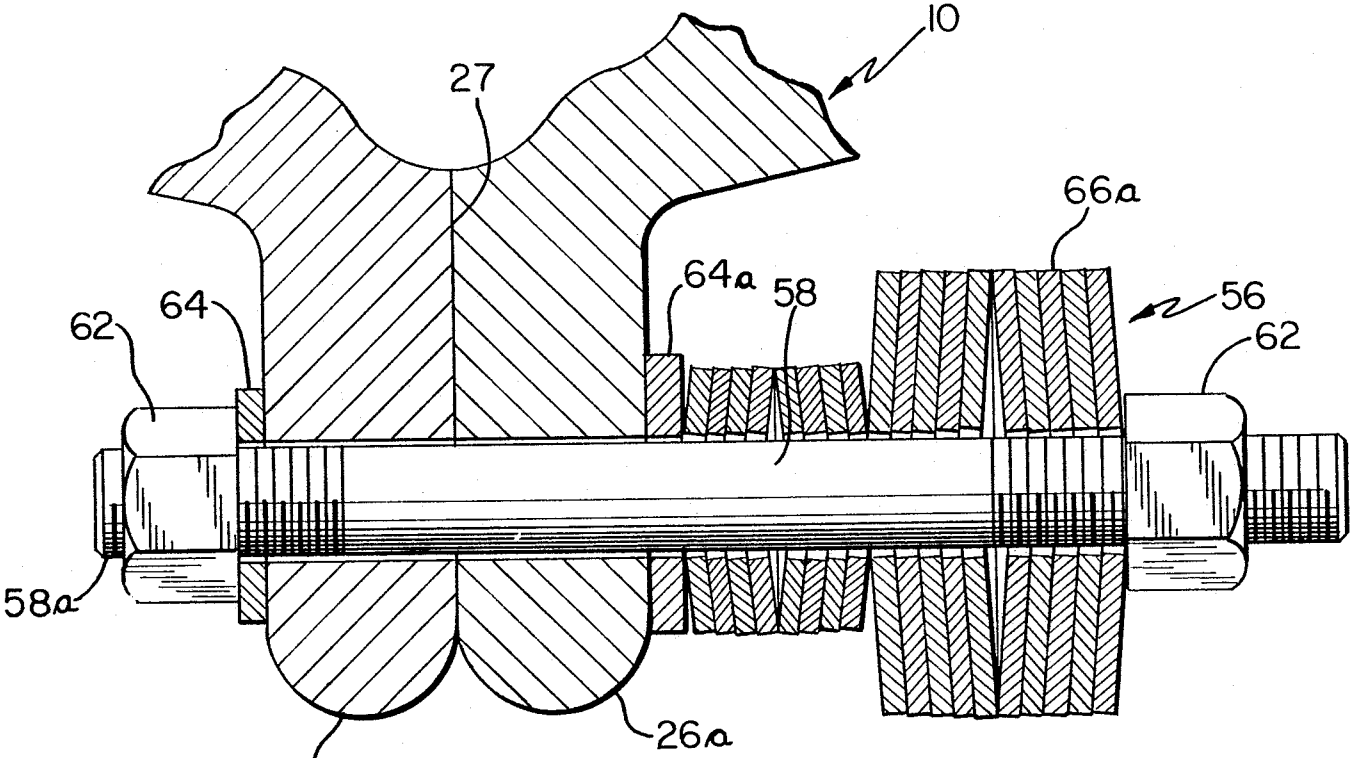
FIG. 7 is a perspective view of another embodiment of ingot mold generally referred to as a one-piece mold structure, and embodying the invention, and having multiple areas of vertical, separable juncture surfaces.

FIG. 7 is a view generally similar to FIG. 4 except that the mold is continuous (non-separable) in its central section (having no openable juncture surfaces in the central portion) while the openable juncture surfaces 27' are located adjacent the upper and lower extremities thereof with associated flange segments in four opposing locations on both the top and bottom portions of the mold. Such openable junctures or slits operate in a general manner as those identified at 27' in the FIG. 4 embodiment. Fastener spring assemblies 56, 56*b* coact with the respective adjacent flange segments, and are preloaded in a similar manner as those in conjunction with the prior described FIG. 4 embodiment, and control the opening of the juncture surfaces 27' of the mold at the top and bottom portions thereof, to aid in relieving stresses in the mold in the manner aforediscussed.

Figure 8:
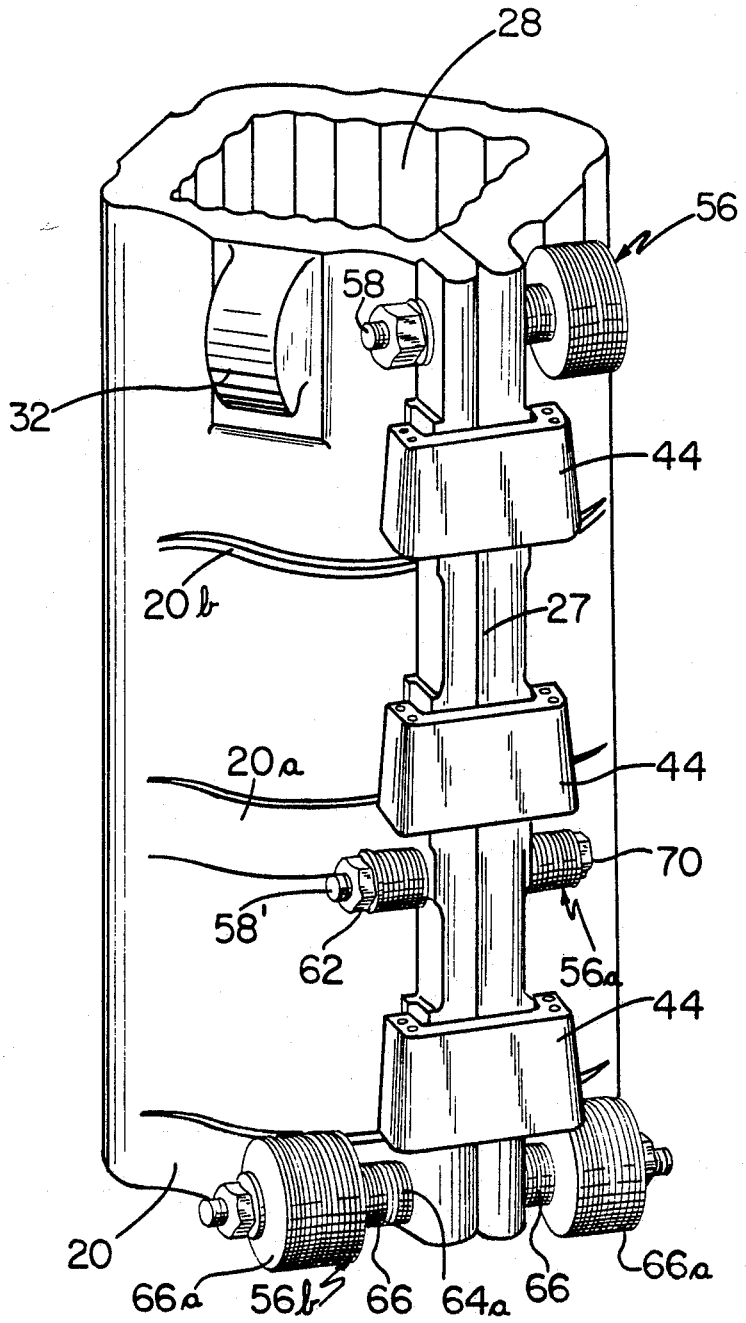
FIG. 8 is a perspective view of a further embodiment of ingot mold, embodying the invention, and being of the type generally referred to as a one-piece mold structure, and having a single area of vertical, separable juncture surfaces extending for the full height of the mold.

FIG. 8 discloses a further embodiment of mold having a single, vertically extending juncture surface 27 therein, and with such single openable juncture surface being held in predetermined closed condition by the clips 44 and spring fastener assemblies 56, 56*a* and 56*b* and are adapted to operate in a generally similar manner as those aforedescribed in conjunction with the first described embodiment of FIG. 1.

A feature of the sectional ingot mold with coupling of fastener means 34, capable of being preloaded to a predetermined amount while providing for expansion and contraction of the mold wall sections after molten metal has been poured into the ingot mold cavity, is seen occuring during the initial pouring of molten metal into the ingot mold cavity, when the resulting initial impact force or dynamic load acting against the mold walls is transferred through the mold wall sections and is partially absorbed by the fastener or coupling means. This reaction of the coupling or fastener means to partially absorb the impact energy force or dynamic load is a result of the preloaded fastener means being flexible enough to allow sufficient deflection to partially absorb the said dynamic load and thus relieve the impact stresses normally associated with molten metal being poured into an ingot mold cavity, yet maintaining sufficient stiffness to impose a predetermined preload, capable of forcing the mold wall sections together to maintain the juncture surfaces in a generally abutting condition until completion of the filling of the mold cavity a predetermined extent with molten metal.

Figure 25:
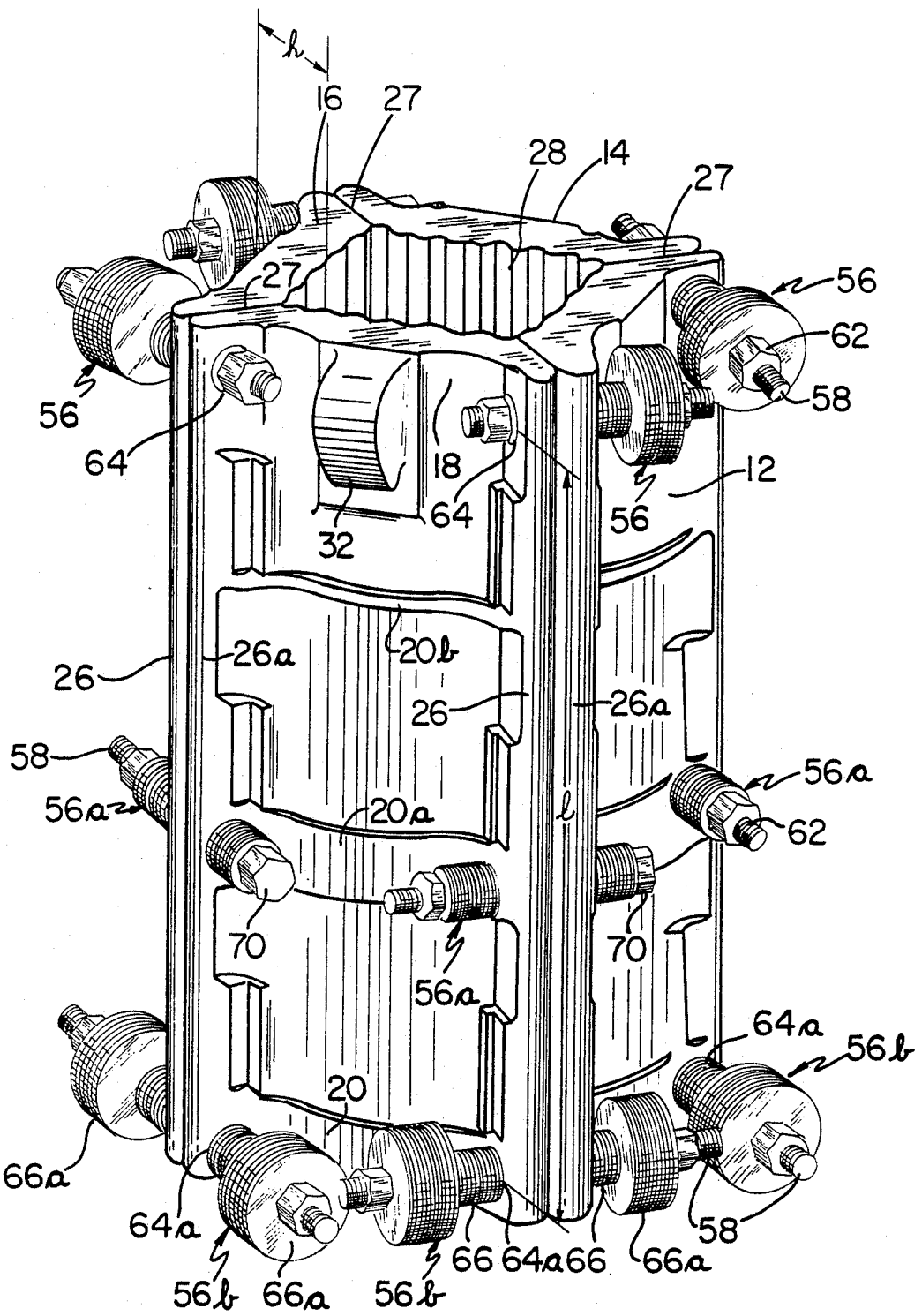
FIG. 25 illustrates another embodiment of an ingot mold assembly generally similar to that of FIG. 1 except that no clip fastener means are utilized in the assembly.

FIG. 25 illustrates an embodiment of an ingot mold assembly generally similar to that of FIG. 1 except that no clips are utilized in the mold assembly, and the spring fastener assemblies 56, 56*a* and 56*b* coacting between the mold sections along the separable junctures thereof are the only coupling means utilized for holding the mold sections 12, 14, 16, and 18 together into an integral unit.

The following design analysis to determine the desired preloading of the spring fastener assemblies 56, 56*a*, and 56*b* is based on an ingot mold assembly of the general FIG. 25 arrangement. The added clip fasteners of for instance the FIG. 1 arrangement provide an added degree of safety to the respective mold assembly in which clip fasteners are also utilized in conjunction with the aforementioned spring fastener assemblies 56, 56*a* and 56*b*.

The design analysis of the segmented mold shown for instance in FIG. 25 (or in FIG. 1) involves three disciplines: heat transfer, thermal stresses and elastic displacements. While each discipline requires a model on which an analysis is based, the numerical results from each model provide data for other steps in the analysis and can be interpreted to establish the performance of the mold.

Heat Transfer Analysis

Figure 9A:
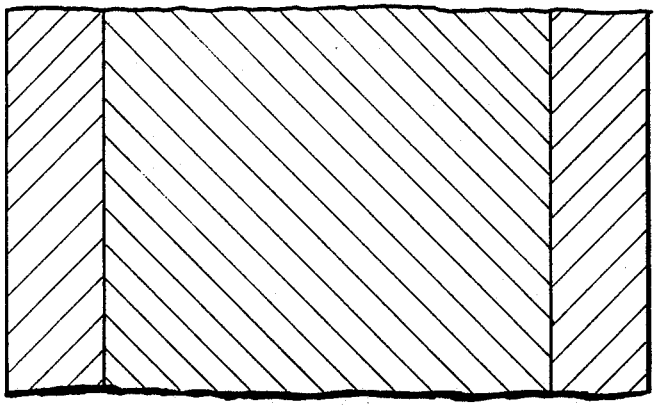
FIG. 9A is a sectional view taken along the plane of line 9A—9A of FIG. 9.
Figure 9:
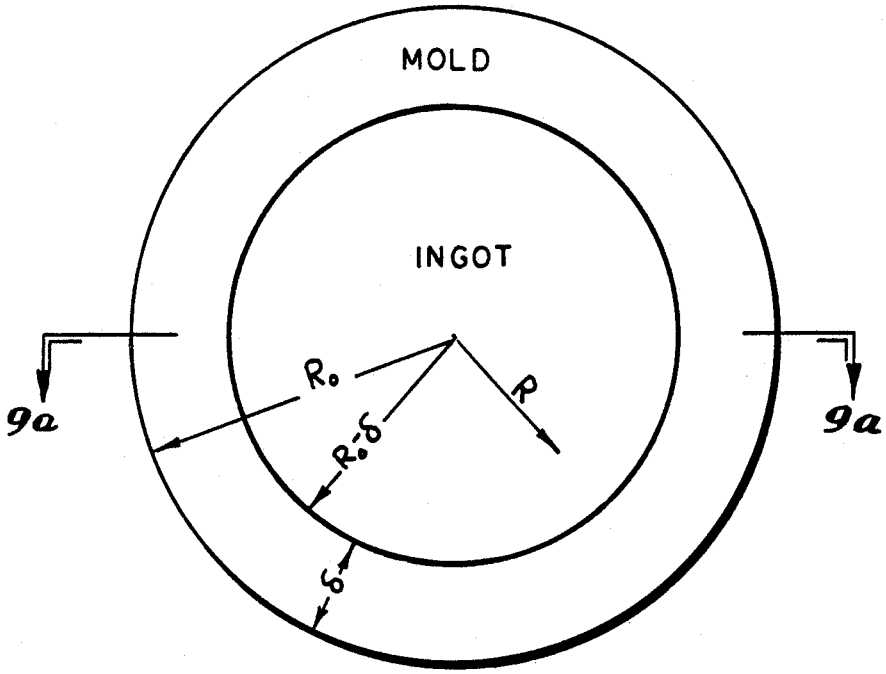
FIG. 9 is a vertical view of a one dimensional Heat Transfer model used in connection with the explanation concerning heat transfer analysis for the determination of the desired preload on the fastener means for the mold sections.

The heat transfer analysis is based on a model of two concentric cylinders, a solid cylinder contained within a cylindrical sleeve, as shown for instance in FIGS. 9, 9A'. The sizes of the cylinders are scaled to generally match the volumes of an actual ingot and mold. The inside solid cylinder represents the ingot which is assumed to be initially at the pour temperature. The outside cylinder represents the ingot mold which is assumed to be initially at ambient temperature. The heat transfer analysis is based on a model of the inner cylinder solidifying from the melt and raising the temperature of the outside culinder. The governing equation is based on the thermal diffusion from the hot ingot into the cold mold $$\rho C_p \frac{\partial T}{\partial t} = k\left(\frac{\partial^2 T}{\partial t^2} + \frac{1}{R}\ \frac{\partial T}{\partial R}\right) \text{For } 0 \leqq t \leqq t^*$$

where $\rho$=density $C_p$=heat capacity k=thermal conductivity $k/\rho C_p$=thermal diffusivity with the following initial conditions at t=0

$$T=T_m\ 0<R<R_o-\delta \text{ (molten ingot)}$$

$$T=T_o\ R_o-\delta<R<R_o \text{ (mold at ambient)}$$

and the following boundary conditions for all time $$\left.\frac{\partial T}{\partial R}\right|_{R=0} = 0$$

symmetry at the center and $$-k\left.\frac{\partial T}{\partial R}\right|_{R=R0} = \epsilon\sigma(T_{R0}^4 - T_0^4)$$

radiation of the outside surface to the surroundings these equations apply until the ingot separates from the mold. For t>t* the ingot has pulled away from the mold at $R=R_o-\delta$ and the heat flux across the small gap takes place by radiation.

$$\underset{\text{ingot}}{-k\left.\frac{\partial T}{\partial R}\right|_{R0-\delta}} = \underset{\text{mold}}{-k\left.\frac{\partial T}{\partial R}\right|_{R0-\delta}} = \epsilon\sigma\,(\underset{\text{ingot}}{T_{R0-\delta-}^4} - \underset{\text{mold}}{T_{R0-\delta+}^4})$$

The aforementioned model is complicated by three elements which must be included in the analysis in order to provide realistic predictions of the temperatures.

(a) The material properties are functions of the temperatures.

(b) The interface between the ingot and the mold provides a resistance to heat transfer (c) The mold transfers heat to its surroundings by radiation and convection.

Referring now to FIG. 10 of the drawings, i—position j—time $$\frac{\partial T}{\partial t} \approx \frac{T_{i,j+1} - T_{i,j}}{\Delta t} \text{ AND } \frac{\partial T}{\partial R} \approx \frac{T_{i+1,j} - T_{i,j}}{\delta r}$$

An exact closed form analytic solution could not be found for this problem so one of the classical approximate solution methods was applied. An array of uniformly distributed points was defined, as shown in FIG. 10. An unknown temperature was identified for each point and the spatial derivatives expressed in terms of finite differences between adjacent points. A solution is then found for each point in the domain for each increment in time. This solution method known in the literature as a Finite Difference Scheme was programmed for the computer. Typical data input to run the heat transfer model includes the following parameters for the mold and ingot material $\rho$=490 lbs/ft$^3$ $C_p$=0.106 Btu/lb-°R k=26 Btu/hr·ft$^2$·°F.

$\alpha'$=0.5 ft$^2$/hr $\epsilon$=0.9 emissivity $\sigma$ = Stephan Boltzmann Constant =

$$0.71718 * 10^{-8} \frac{\text{Btu}}{\text{hr} \cdot \text{ft}^2 (°\text{R})^4}$$

and with $R_o$=2.28 ft $\delta$=10.5 in $T_m$=2815° F.

$T_o$=30° F. (winter experiment)

The following Table I shows the results for two successive time increments t=approximately $60_{sec}$ and t=approximately $65.9_{sec}$ from commencement of the entry of molten metal into the mold. It is interesting to note that the outside of the mold is just beginning to experience an increase of temperature in spite of the fact that the interface between the molten metal and the interior surface of the mold has already increased to almost 1000° F.

TABLE I

TWO TYPICAL SUCCESSIVE TEMPERATURE PROFILES THROUGH THE INGOT AND MOLD.

| TIME = 59.885568 SEC | TIME = 65.8741247 SEC |
|---|---|
| INGOT-CENTER TO INTERFACE | INGOT-CENTER TO INTERFACE |
| TEMPERATURE AT 0 = 2815 | TEMPERATURE AT 0 = 2815 |
| TEMPERATURE AT .0912 = 2815 | TEMPERATURE AT .0912 = 2815 |
| TEMPERATURE AT .1824 = 2815 | TEMPERATURE AT .1824 = 2815 |
| TEMPERATURE AT .2736 = 2815 | TEMPERATURE AT .2736 = 2815 |
| TEMPERATURE AT .3648 = 2815 | TEMPERATURE AT .3648 = 2815 |
| TEMPERATURE AT .456 = 2815 | TEMPERATURE AT .456 = 2815 |
| TEMPERATURE AT .5472 = 2815 | TEMPERATURE AT .5472 = 2815 |
| TEMPERATURE AT .6384 = 2814.99997 | TEMPERATURE AT .6384 = 2814.99985 |
| TEMPERATURE AT .7296 = 2814.99882 | TEMPERATURE AT .7296 = 2814.99646 |
| TEMPERATURE AT .8208 = 2814.97563 | TEMPERATURE AT .8208 = 2814.94488 |
| TEMPERATURE AT .912 = 2814.66357 | TEMPERATURE AT .912 = 2814.38625 |
| TEMPERATURE AT 1.0032 = 2811.74004 | TEMPERATURE AT 1.0032 = 2809.99126 |
| TEMPERATURE AT 1.0944 = 2792.34323 | TEMPERATURE AT 1.0944 = 2784.7376 |
| TEMPERATURE AT 1.1856 = 2701.4841 | TEMPERATURE AT 1.1856 = 2679.71022 |
| TEMPERATURE AT 1.2768 = 2407.68083 | TEMPERATURE AT 1.2768 = 2371.15713 |
| TEMPERATURE AT 1.368 = 1781.49724 | TEMPERATURE AT 1.368 = 1757.921 |
| INTERFACE INGOT/MOLD | INTERFACE INGOT/MOLD |
| TEMPERATURE AT 1.4592 = 967.555507 | TEMPERATURE AT 1.4592 = 985.846558 |
| TEMPERATURE AT 1.5504 = 380.311341 | TEMPERATURE AT 1.5504 = 410.721673 |
| TEMPERATURE AT 1.6416 = 122.038635 | TEMPERATURE AT 1.6416 = 139.461659 |
| TEMPERATURE AT 1.7328 = 47.247934 | TEMPERATURE AT 1.7328 = 52.9982641 |
| TEMPERATURE AT 1.824 = 32.3215116 | TEMPERATURE AT 1.824 = 33.5617632 |
| TEMPERATURE AT 1.9152 = 30.2232238 | TEMPERATURE AT 1.9152 = 30.4067379 |
| TEMPERATURE AT 2.0064 = 30.0149942 | TEMPERATURE AT 2.0064 = 30.0338789 |
| TEMPERATURE AT 2.0976 = 30.0006695 | TEMPERATURE AT 2.0976 = 30.0020043 |
| TEMPERATURE AT 2.1888 = 30.0000179 | TEMPERATURE AT 2.1888 = 30.0000799 |
| TEMPERATURE AT 2.28 = 30.0000004 | TEMPERATURE AT 2.28 = 30.0000039 |
| OUTSIDE OF MOLD | OUTSIDE OF MOLD |

The heat emitted by the solidification of the ingot will continue to transfer into the mold through a model of simple conductivity moving these two elements closer to thermodynamic equilibrium. As this happens the ingot tends to shrink because of the volumetric changes on solidification and the reduction of temperature. At the same time the mold tends to grow and distort due to the nonuniform rise in temperature. When the solidified skin of the ingot develops sufficient structural integrity to support the ferrostatic head of the molten ingot core, a gap between the ingot and the mold develops. Thereafter the heat flux is impeded because the air gap produces a resistance to the path. Heat transmission across the gap then takes place by radiation rather than by conduction.

Figure 11:
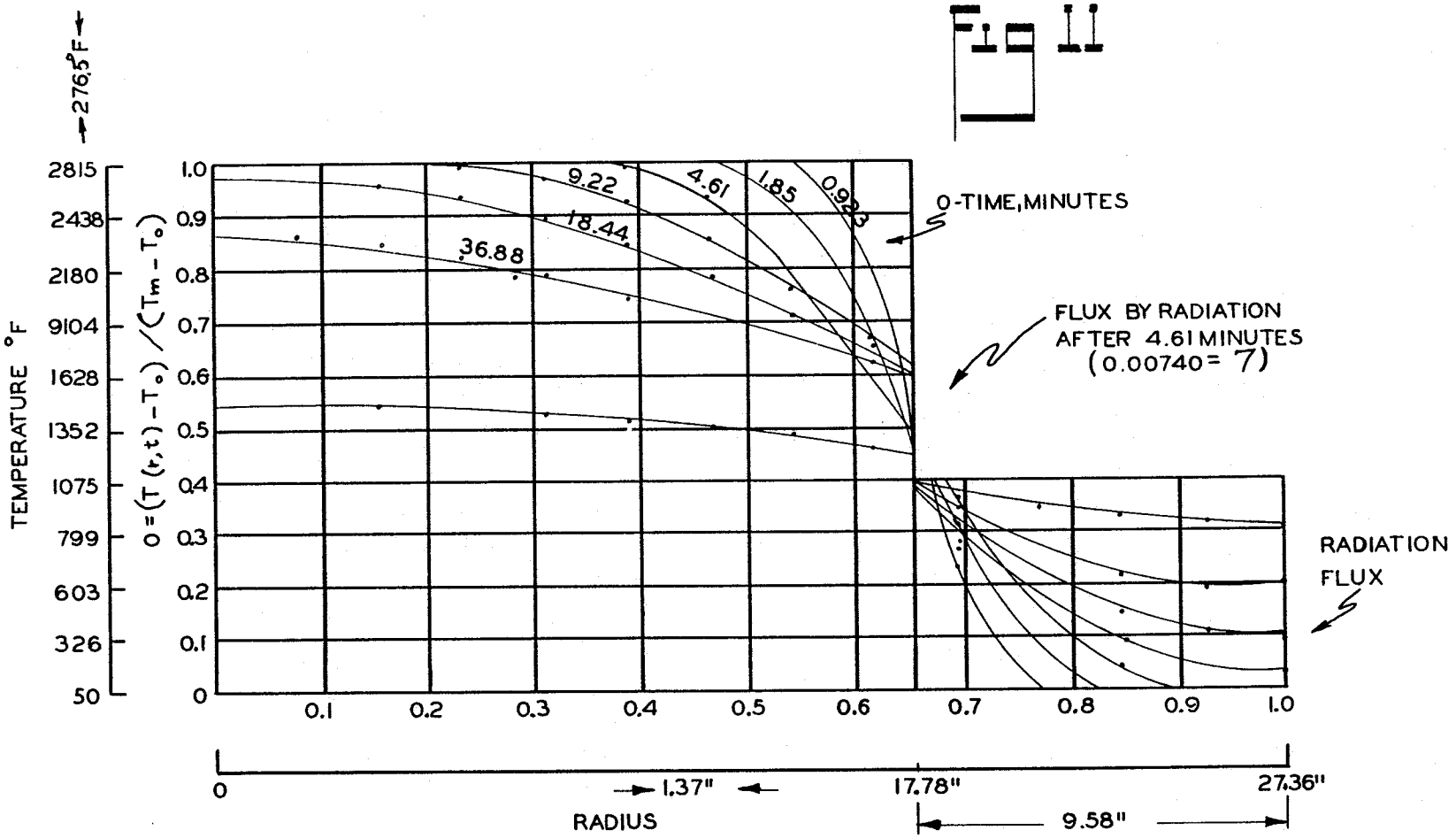
FIG. 11 is a radial temperature profile graph of the heat transfer model of mold shown in FIGS. 9 and 9A, for specific times from the commencement of the pour, and illustrating the effect of separation of the ingot from the interior surface of the mold when the ingot skin possesses sufficient structural integrity to support the molten interior of the poured ingot.
Figure 12:
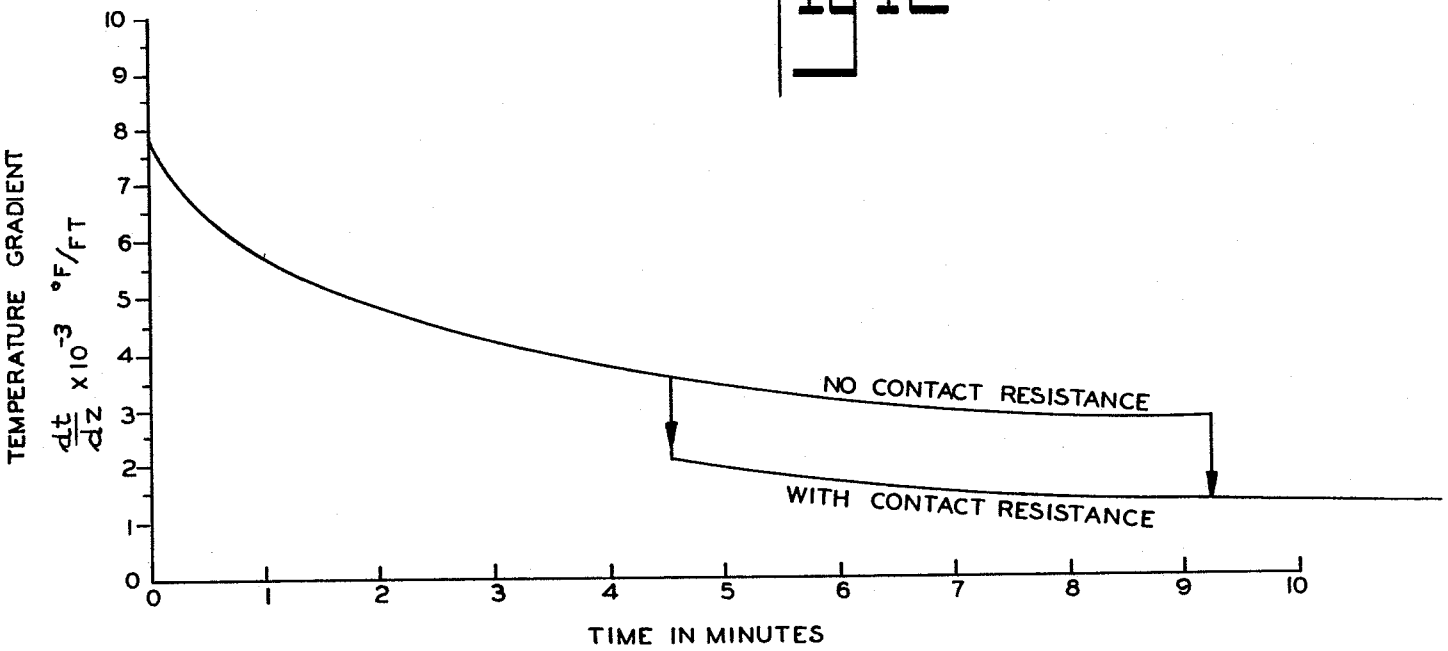

FIG. 11 shows the temperature profile through the ingot and mold wall for various fixed times (0.923 min, 1.85 min, 4.61 min, 9.22 min . . . ) For this particular set of data an air gap develops between the ingot and the mold after approximately 4.61 minutes from the commencement of the pour. The temperature profiles are smooth continuous curves through the ingot mold interface for times up to 4.61 minutes. Thereafter a discontinuity of the temperature profile develops because of the air gap. The temperature of the outside of the ingot increases because it is "upstream" to the resistance while the temperature of the inside of the mold decreases because it is "downstream" and heat input is reduced.

Figure 12:
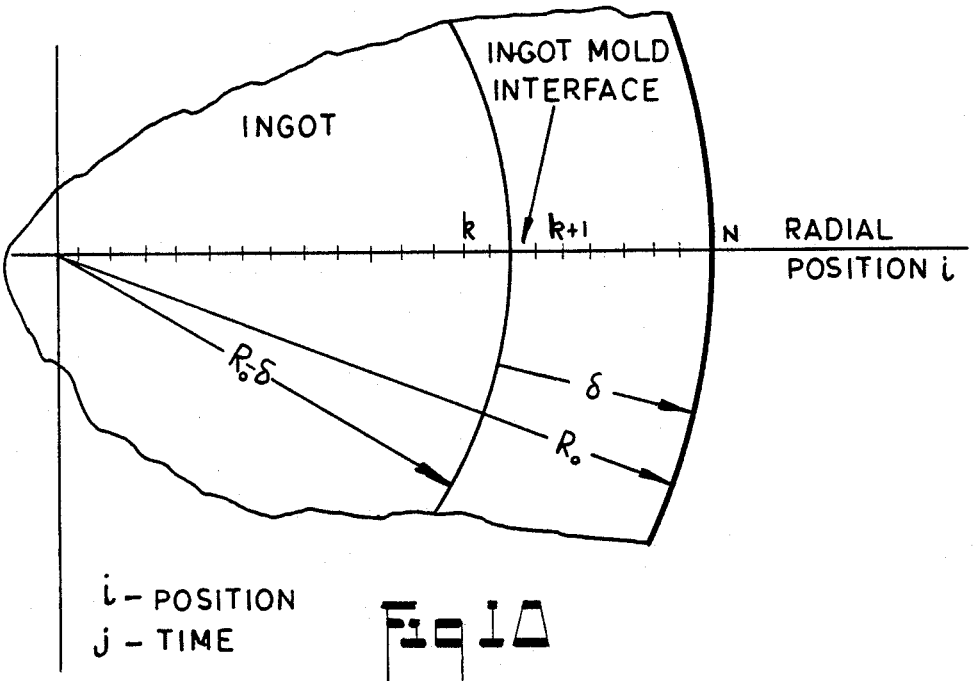
FIG. 12 illustrates a plot of the temperature of the interior surface of the mold wall, illustrated in FIGS. 9, 9A for the instances of "no contact resistance" as compared "with contact resistance", or in other words with an air gap in existence between the ingot skin and the mold wall interior surface.

FIG. 12 shows a plot of the temperature of the inside mold wall for the cases of "no contact resistance" and "with contact resistance" (i.e. with air gap). The case of "with contact resistance" is based on a radiation heat transfer model and may exaggerate somewhat the resistance. These two models probably bound the true solution and provide a reasonable guideline for the temperature profiles. The program is therefore capable of estimating the temperature distribution in both the ingot and the mold for each time increment for the mold and ingot characteristics specified in the input.

Thermal Stress Analysis

Figure 13:
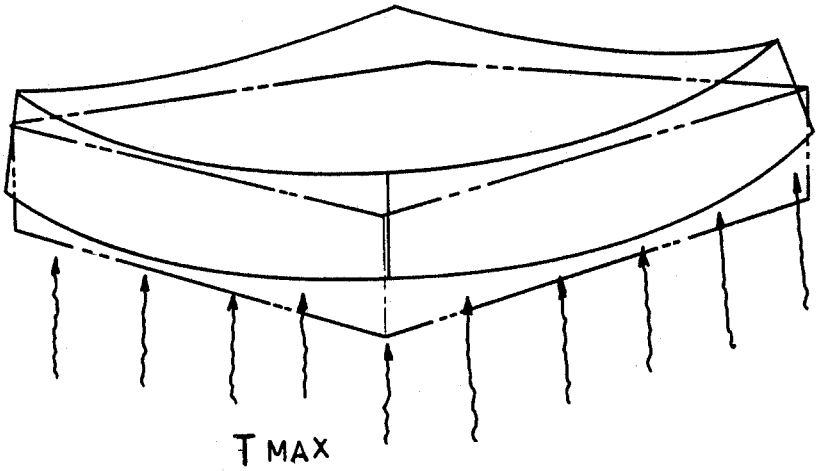
FIG. 13 is a perspective diagrammatic view showing for illustrative purposes the free thermal bending that occurs upon the heating of one side of a uniform thickness plate section.

The thermal stress analysis is based on a model of a flat plate subjected to a thermal gradient through the thickness which is assumed to be uniformly distributed over the plan form, as shown in FIG. 13. The thermal gradients are determined from the finite difference analysis and used to determine the thermal thrust $N_T$ and $M_T$ thermal moment.

$$N_t = \int \alpha E T(z) dz = \Sigma \alpha E T_i \Delta z_i$$

$$M_T = \int \alpha E z T(z) dz = \Sigma \alpha E z_i T_i \Delta z_i$$

Figure 14:
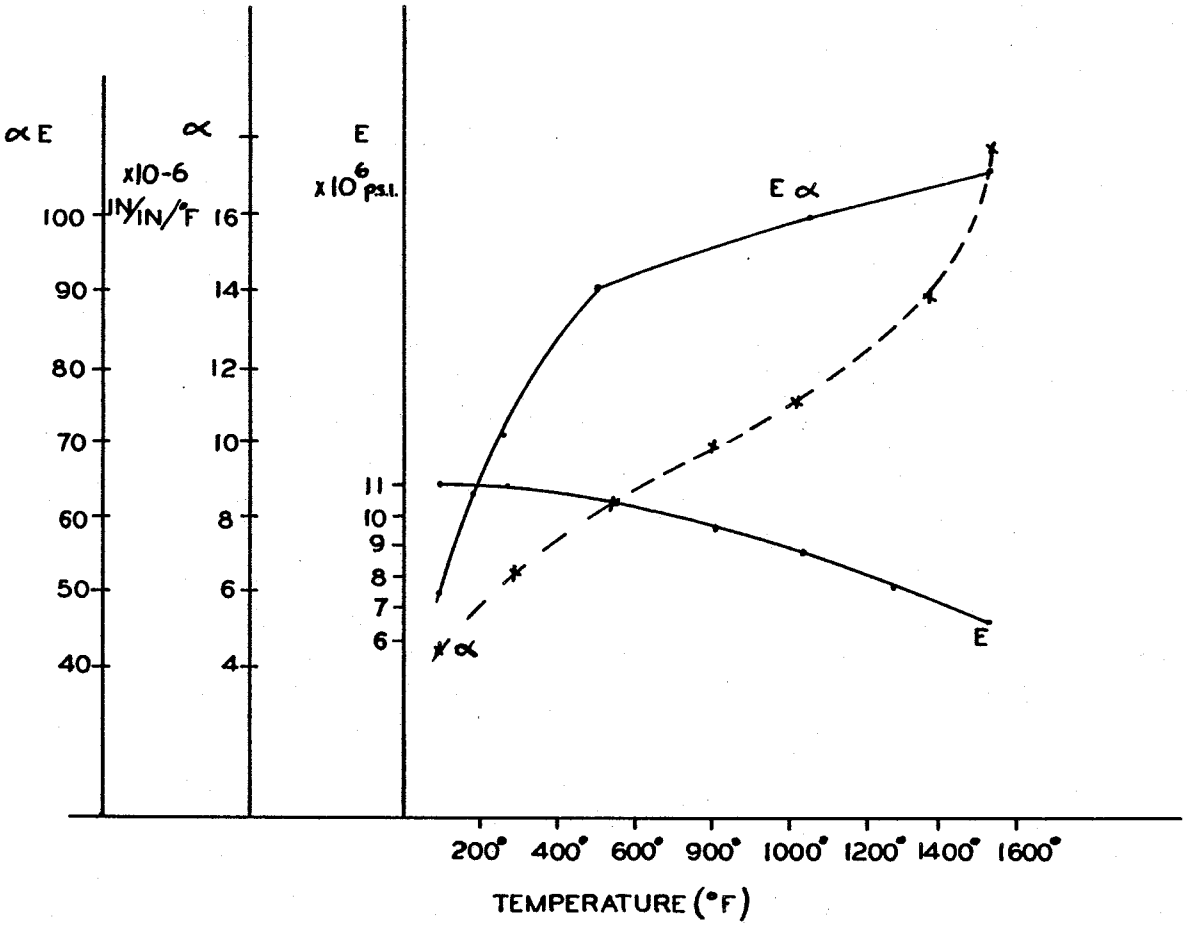
FIG. 14 is a graph of the thermal expansion coefficient $\alpha$ and the modulus of elasticity E in conjunction with temperature, and particularly for Class 20 cast iron, which represents a typical material from which the molds of the invention may be found.

It is important to recognize that thermal expansion coefficient $\alpha$ and the modulus of elasticity E are functions of temperature. FIG. 14 is a plot of these two parameters for Class 20 cast iron, a material with properties similar to the typical mold material which may be blast furnace iron. Included also is a plot of the $\alpha E$ product for the temperature range of 70° F. to 1600° F. It is interesting to note that the $\alpha E$ product is approximately constant at a value of 100 for 500° F. to 1600° F. This observation serves as the basis for approximating the thermal thrusts and moments as $$N_T = \alpha E \Sigma T_i \Delta z_i \text{ and } M_T = \alpha E \Sigma z_i T_i \Delta z_i$$

Values for the thermal thrust $N_T$ and the thermal moment $M_T$ can be approximated by one of two methods based on the temperature profiles generated by the heat transfer analysis.

Integral of a Continuous Function

Figure 15:
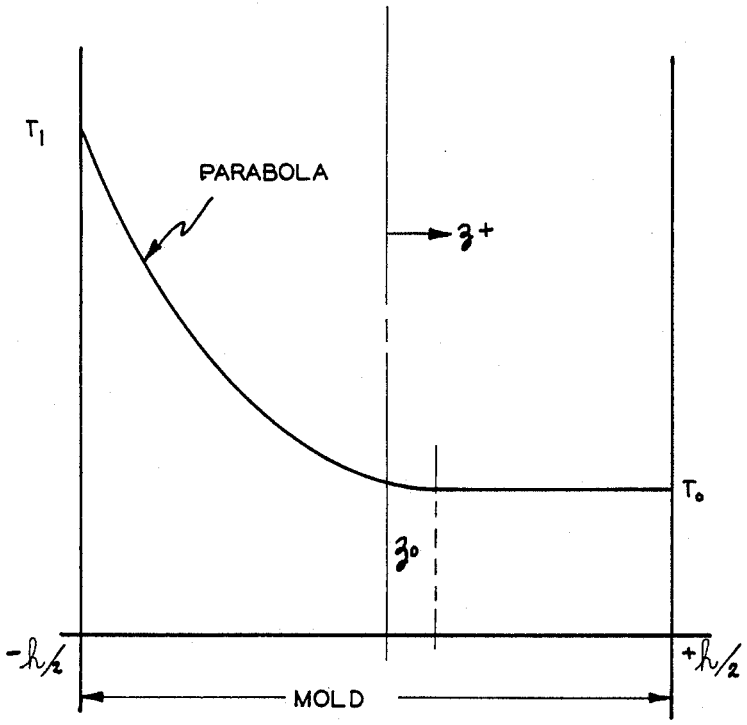
FIG. 15 is an approximate temperature profile in a mold wall of a typical ingot mold embodying the invention.

In the first scheme, an analytic function is fitted to the computer generated temperature profile for the mold wall. FIG. 15 is a plot of the temperature profiles for the mold wall for several samples. These profiles were approximated by two continuous functions A parabola $$T(z) = T_0 + \frac{(z - z_0)^2}{h^2} T_1 \quad -\frac{h}{2} < z < z_0$$

and a constant $$T(z) = T_0 \quad z_0 < z < \frac{h}{2}$$

For these approximations the thermal moment becomes $$M_T = \alpha E \left\{ \left[ \frac{T_0 z^2}{2} + \frac{T_1}{h^2} \left( \frac{z^4}{4} - \frac{2}{3} z_0 z^3 + \frac{1}{2} z_0^2 z^2 \right) \right]_{-\frac{h}{2}}^{z_0} + \left[ \frac{T_0 z^2}{2} \right]_{z_0}^{\frac{h}{2}} \right\}$$

which becomes $$M_T = -\frac{\alpha E T_1}{h^2} \left\{ \frac{1}{64} h^4 + \frac{1}{12} z_0 h^3 + \frac{1}{8} z_0^2 h^2 - \frac{1}{12} z_0^4 \right\}$$

For the time increments shown in FIG. 11, the thermal moments were calculated according to this approximation as

| t (minutes) | $M_T$(in-lb/in) |
|---|---|
| 0.923 | −566,000 |
| 1.850 | −730,000 |
| 4.61 | −842,000 |

The thermal thrusts $N_T$ were not estimated since they do not contribute to the thermal bending distortions.

Discrete Sum

Alternatively the thermal moments can be calculated using the temperatures at the discrete finite difference grid points and the discrete slice $\Delta Z_i$. This calculation was programmed for the computer and coupled to the heat transfer program to provide estimates of $M_T$ for each time increment.

Figure 16:
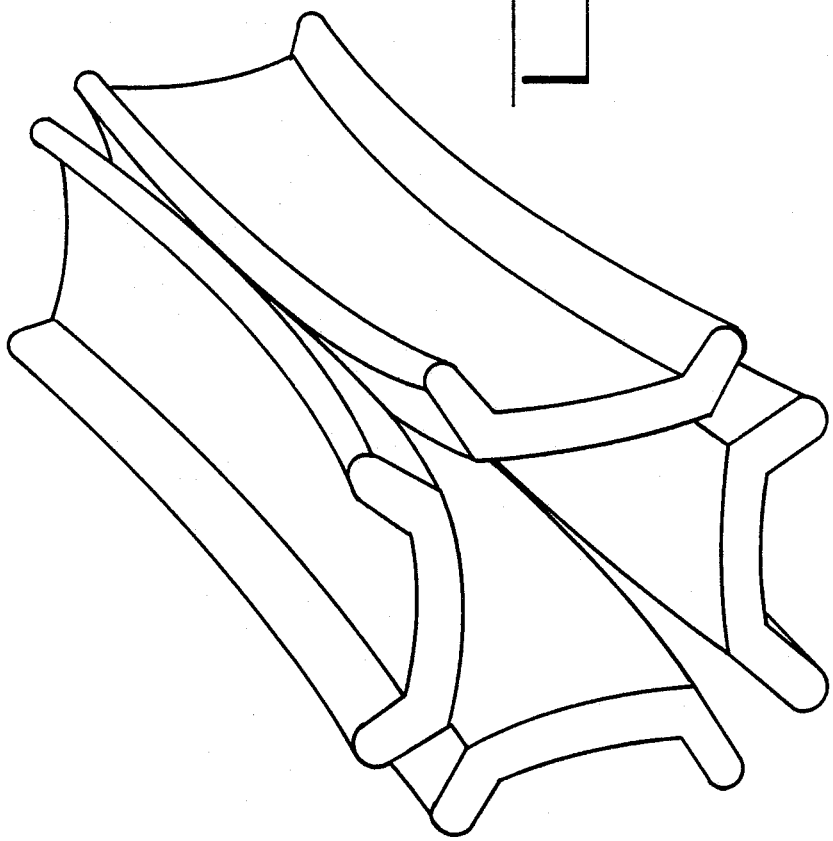
FIG. 16 is a diagrammatic perspective view showing free thermal bending that could occur in a sectional ingot mold of the general type illustrated in the drawings when molten metal is poured into the mold's interior, thereby causing heating of the latter.

Using these estimates for the thermal moments, the free thermal distortions of each mold section is estimated. For this analysis, the plate (i.e. mold sections) are assumed to be free to displace, and because of the symmetry of the loading the plate deforms into the shape of a spherical segment, as shown in FIG. 16.

$$W = -\frac{3M_T}{4Eh^3}(x^2 + y^2) \text{ for the midsurface}$$

The stresses are as follows:

$$\sigma_x = \sigma_y = \frac{1}{1 - \nu} \left\{ -\alpha E T(z) + \frac{N_T}{2h} + \frac{3z}{2h^3} M_T \right\}$$

For the case where the mold section is free to displace and form this spherical shape.

The displaced shape maintains the center of the mold sections in contact with one another and displaces the edges and corners away from the ingot. For a one-piece mold composed of four flat mold sections or plates integrally attached at the corners, the restraining of the free displacement of each plate in to spherical sectors produces exaggerated stresses at the adjoining corners. Since the mold of the invention is segmented at the corners, corner stresses in the FIG. 16 mold assembly do not develop.

However, the mold must be connected at the corners by some fastener means to contain the molten ingot. For this case, a conservative estimate of the stresses can be determined by assuming that the fastener means and edge restraint are sufficient to remove the thermal moments but not the thermal thrusts.

Elastic Displacement Analysis

The elastic displacement analysis is based on an elastic plate stiffened with two ribs on the vertical edge as illustrated for instance in the mold sections of FIGS. 25 or 9. The plates are restrained in the free displacement to a spherical sector by the spring fastener assemblies used to keep the mold walls together. The attachments have to be designed to keep the mold segments together and aid in preventing leakage of the molten ingot, or cracking of the solidified skin of a cooling ingot.

For the case of extremely large molds, i.e., particularly tall heights (e.g. 100 inch tall mold assembly with the transverse interior dimension of the mold cavity being between approximately 28–32 inches) the free thermal expansion tends to dominate. The mold will tend to spring open during the early stages of the pour because of the accumulated thermal displacements of the spherical shape over the large span. These molds tend to leak at the seam lines unless an adequate load is available to restrain the displacements. In this situation an elastic attachment capable of preloading to significant levels is desirable. Thus, this arrangement will be dominated by the thermal-elastic consideration with the ferrostatic loads playing a minor role. Since the ingot solidifies from the bottom to the top, and the top is the last portion of the ingot to be poured, the following criterion for the design of the mold segment clamping forces can be established.

Top Clamps

The preload in the spring clamps 56 at the top of the mold should be sufficient to prevent leakage of freshly poured material at the end of the pour, namely at approximately 120 seconds for a 100 inch tall mold having an approximate 30 inch interior diameter.

Bottom clamps

The preload in the spring clamps **56*b*** at the bottom of the mold should be sufficient to support the skin of a partially solidified ingot until such time as the ingot skin has cooled and developed enough structural integrity to support the molten interior.

Central clamps

The preload in any of the generally intermediately located spring clamps **56*a*** can be used to assist the lower clamps in supporting the ferrostatic head.

Figure 17:
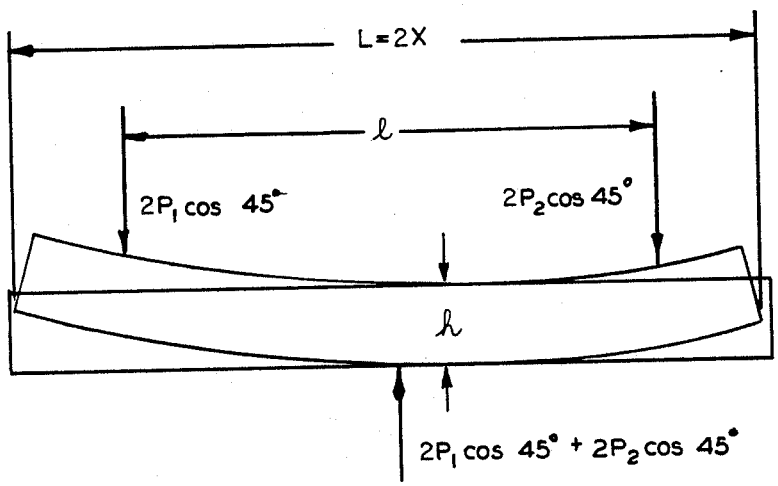
FIGS. 17 and 17A illustrate a simple plate model useful in estimating the necessary clamping forces for maintaining the flanged juncture surfaces of the mold in generally abutting condition until completion of the filling of the mold cavity and during predetermined ingot solidification for the elastic analysis.
Figure 17A:
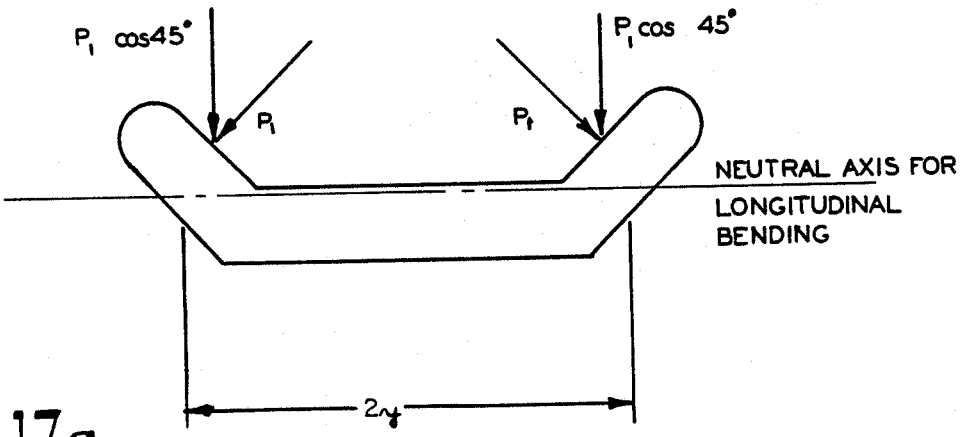

FIGS. 17, 17A present the simple plate model used to estimate the desired clamping forces. The primary bending deformation can be calculated from the displacement equation of a centrally loaded uniform beam by equating this displacement to the free thermal displacements.

$$W = \frac{Fl^3}{48EI} = -\frac{3M_T}{4Eh^3}(x^2 + y^2)$$

where $I = wh^3/12$. Substituting $F = 1.414\ (P_1 + P_2)$ and approximating $P_1 = P_2$ leads to the following equation for P $$P = \frac{-3M_T\, w(x^2 + y^2)}{2.828l^3}$$

Substituting the following dimensions for the 100" ingot mold x=50", l=80", y=w/2=24" the following approximate expression for the bolt force can be determined.

$$P = 0.306M_T$$

Using this formula, the forces necessary to keep the mold closed during the ingot solidification are estimated as follows:

| time | $M_T$in./lb/in | P in Pounds |
|---|---|---|
| 0.923 | −566000 | 173,000 |
| 1.85 | −730000 | 223,000 |
| 4.61 | −842000 | 257,600 |

Therefore a clamping force of approximately 257,600 pounds is required to keep the top of the sectional mold closed for approximately the first five minutes from commencement of the pour. Small amounts of separation of the outermost lateral edges of the flanges 26, **26*a*** on the mold segments tend to occur.

Furthermore, the clamping force at the bottom of the mold should be slightly larger than the clamping force at the top. This will insure that the first separation of the juncture flange surface 27 will occur at the top where faster stabilization of the ingot skin occurs. The clamping forces (or preload) for each fastener assembly were thus conservatively set at 300,000 pounds. For the case under discussion 3" diameter high strength aircraft quality bolts (B7) were selected for use in the spring fastening assemblies.

The bolts 58 which supply such a clamping force to keep the mold sections closed during the pour and the early stages of solidification must then allow the mold segments to bend due to the thermal moments. Therefore the bolts are elastically interfaced with the mold by means of the disc springs of the assemblies to allow the thermal distortions.

Figure 18:
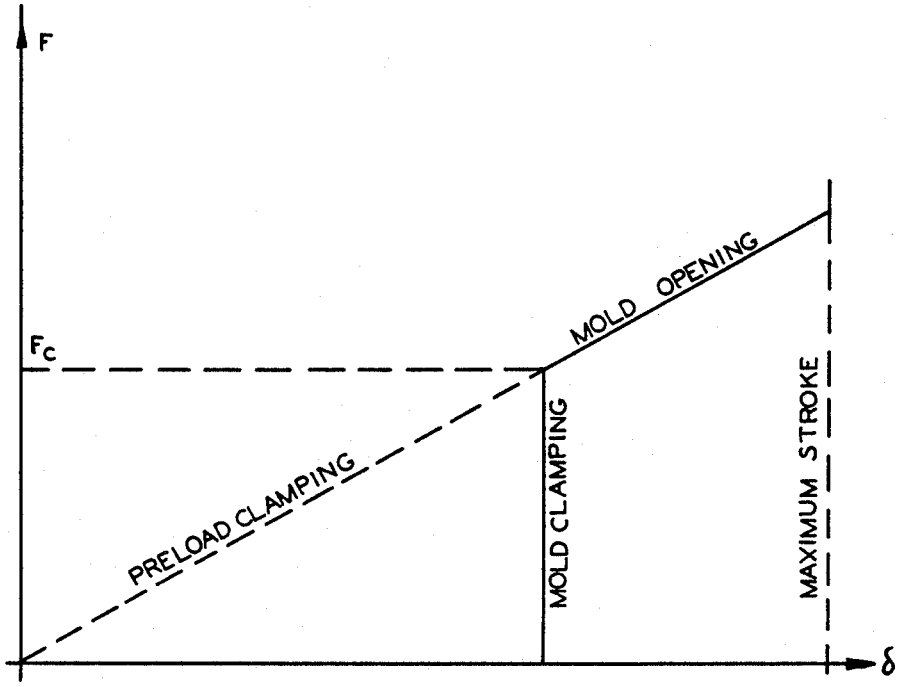
FIG. 18 illustrates a force displacement curve for the preloading of the adjustable fastener means to achieve an adequate clamping force from the adjustable fastener means to keep the mold closed furing the pouring and the formation of an ingot skin having sufficient structural integrity to support the molten interior of the ingot.

The force displacement curve of FIG. 18 indicates the curve for the preloading necessary to achieve a clamping force adequate to keep the mold closed during the pour. Thereafter the mold opens until the springs of the fastener assemblies reach their maximum stroke and the associated bolts 58 restrain the mold walls from further thermal displacements.

Belleville Washers

Figure 21:
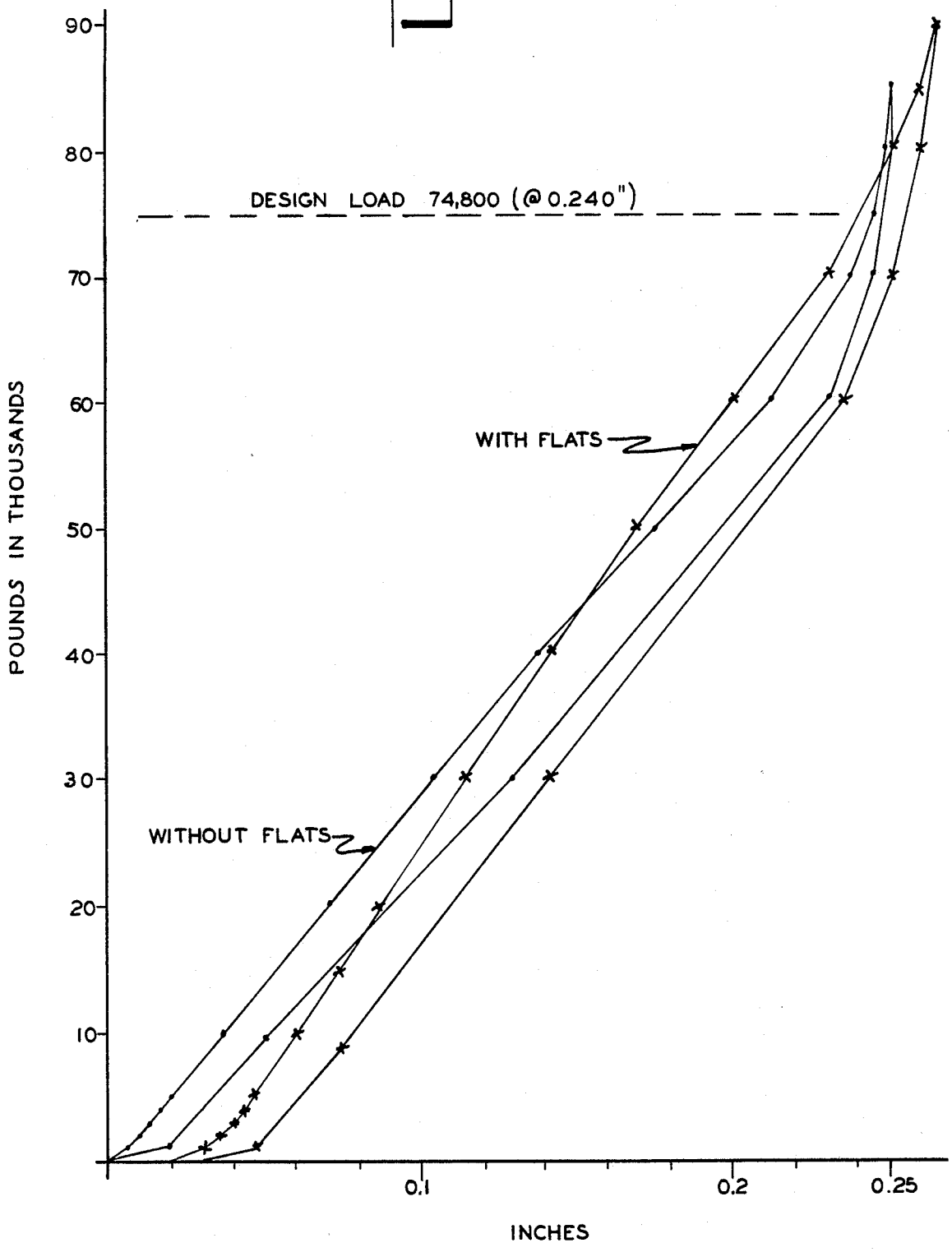
FIG. 21 is an illustration of the force displacement curves of the larger Belleville springs of FIG. 19, both with and without the flats on the top inside and bottom outside corners.

Considering the limitations of space and the structural demands of extremely highloads, Belleville Washers are preferred for the spring fastener assemblies. Using the equation for the stress analysis of Belleville Washers, a computer program was prepared and the washers shown in FIGS. 19 and 20 were designed. The corresponding force-displacement plots for the 12" diameter washers is shown in FIG. 21. A similar curve is obtained for the 7.0" or smaller diameter washers.

Figure 22:
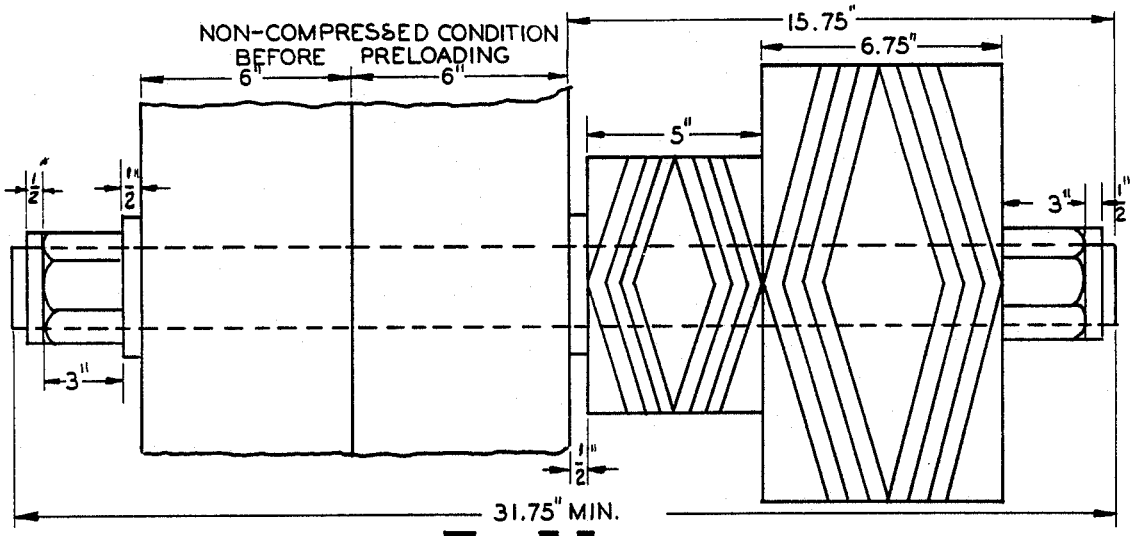
FIG. 22 is a generally diagrammatic elevational view of the top disc spring fastener arrangement shown in FIGS. 1 and 3, and showing dimensional relationships in a particular ingot mold assembly.
Figure 23:
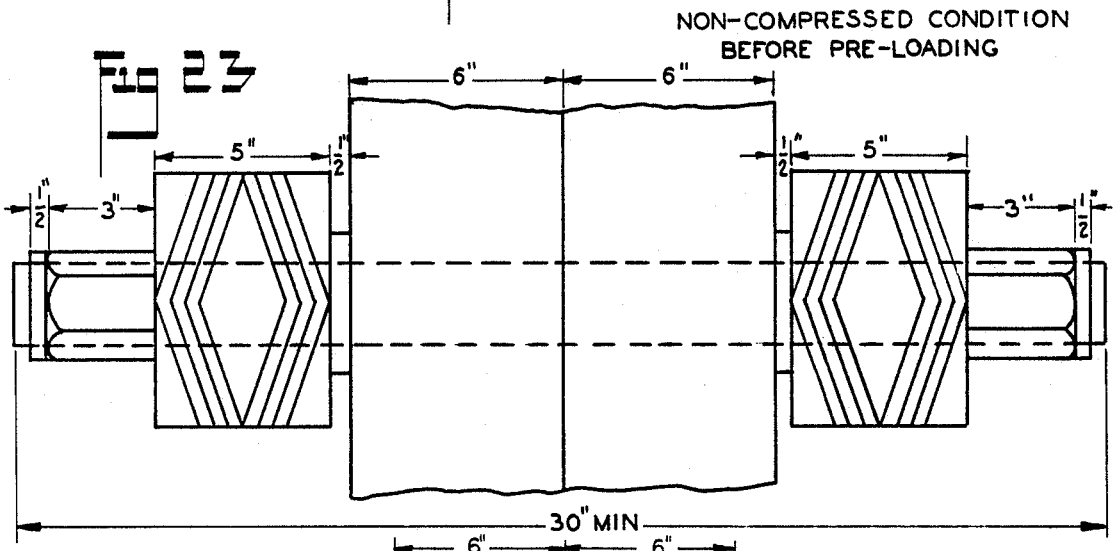
FIG. 23 is a view similar to FIG. 22 but illustrating the middle disc spring fastener assembly of FIGS. 1 and 2 for particular ingot mold assembly.
Figure 24:
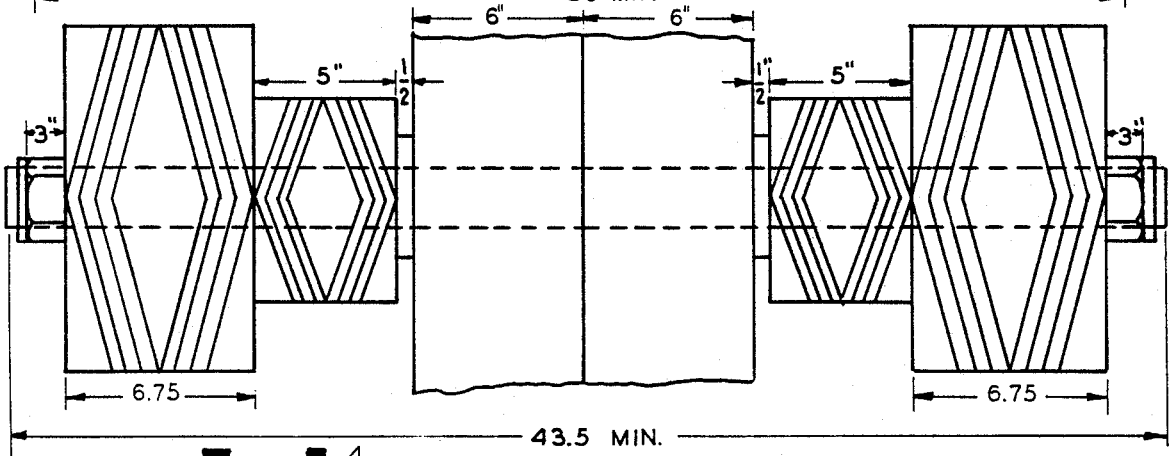
FIG. 24 is a view similar to FIGS. 22 and 23 but illustrating the lower disc spring fastener assembly of FIG. 1.

When two Belleville Washers are nested together, the force required to achieve a given displacement add together. When two Belleville Washers are stacked in opposition, the resulting displacements add. The two washer designs were selected so that small washers would require approximately 100,000 pounds to flatten each washer. At the same time the large washers would require approximately 75,000 pounds to flatten each washer. By taking advantage of the possible stacking sequences and friction, it becomes possible to stack sequences of the washers to provide the desired clamping forces and still permit a maximum travel after the mold sections commence to separate. FIGS. 22, 23, and 24 indicate the stacking sequences of both the large and small washers for respectively the top, middle and bottom fastener clamps. The preload force values are measured by inserting a feeler gage between the Belleville Washer and the adjacent bearing plate (e.g. 64*a*). For each of the stacking sequences illustrated, the desired clamping force is achieved by preloading each Belleville disc and supporting bolt assembly (e.g. 56, 56*a*, 56*b*) to approximately half of its maximum travel capacity. In other words the preload on each fastener assembly is preferably such so as to accomplish as the preload condition, approximately one-half the maximum travel of the respective fastener assembly from a completely non-compressed condition to a completely compressed condition, with the disc springs in the last mentioned completely compressed condition having no further resiliency and being completely closed.

It will be understood therefore that the mold spring fastener assemblies must be sized to provide support for the adjacent mold section walls during the solidification process of the ingot.

The spring supporting the bolts of the fastener assemblies must be sized to provide enough displacement freedom to minimize the restrained thermal stresses.

The preload on the spring fastener assemblies connecting the mold segments must be sized in conjunction with the associated clip fasteners 44, to keep the mold segments together and prevent leakage at the flange juncture surface while the interface between the ingot and the interior of the mold is molten.

The mold assembly illustrated in FIG. 25 is approximately 100 inches tall (about 8⅓ feet) with the wall thickness of the mold sections being approximately 10.5 inches, and with the inside transverse or cross dimension of the mold cavity being approximately 28 inches at the top of the mold and approximately 32 inches at the bottom of the mold. Thus the cavity, in the embodiments illustrated is tapered outwardly in a downward direction. The temperature of the metal poured into the mold for formation of the ingot may be in the order of 2800° F. The height of molten metal to which the mold is poured is generally determined by the desired weight of the produced ingot, as determined by the orders given to the production mill. However conventionally, metal is poured to within approximately six inches of the top of an ingot mold of the aforementioned 100 inch mold cavity height.

From the foregoing discussion and accompanying drawings, it will be seen that the invention provides an ingot mold provided with means affording stress relief thereto for the ingot pouring operation, while maintaining the mold in condition to aid in preventing metal leakage therefrom during the ingot pouring operation and subsequent cooling of the ingot, and providing mold wall support for the ingot until its skin has sufficient structural integrity to support the molten interior of the ingot, and a mold which can be recycled for use in a faster manner as compared to heretofore utilized solid or one-piece type ingot molds. In certain embodiments, the mold is formed of a plurality of completely separate and individual side wall sections defining at least the side periphery of a mold cavity, together with coupling means connecting the wall sections together. The coupling means provide for expansion and contraction of the mold sections relative to one another during the pouring of molten metal into the mold, and the resultant heating and subsequent cooling thereof. At least certain of such coupling means comprises adjustable spring means able to be preloaded a predetermined extent prior to the pouring operation, and thus providing for predetermined preloading of the openable and closeable junctures between the mold sections. In other embodiments, the mold may be of a generally one-piece affair, but having side wall sections with junctures openable and closeable, together with the aforementioned coupling means, including preloadable spring means, for automatic compensation for expansion and contraction of the mold during the pouring and ingot producing cycles thereof in a manner to provide stress relief to the mold. A novel method for production of metal ingots is also disclosed.

What is claimed is:

1. A pair of disc-type fastener assemblies adapted for assembly in vertically spaced relation and with ingot mold wall sections for clamping the wall sections together along generally vertically extending juncture surfaces, said assemblies being capable of applying to the juncture surfaces of the mold wall sections a predetermined amount of force generally adjacent the upper and lower ends of the ingot mold, each said assembly comprising an elongated longitudinally extending tie member having means adjacent at least one end thereof for adjusting the effective length of said tie member, and a plurality of sets of centrally apertured Belleville disc springs mounted on said tie member, with the latter extending through the respective aperture in each disc spring, each said assembly when installed on adjacent mold wall sections being adapted for preloading by adjustment of said means on the end of said member for maintaining engagement between the confronting surfaces of said sets and for maintaining the juncture surfaces of the adjacent ingot mold wall sections in generally engaged abutting condition until the completion of filling of the mold cavity with molten metal and the formation of an ingot skin on the produced ingot having sufficient structural integrity to support the molten interior of the ingot, after which said disc springs will compress further to permit separation of the mold wall sections juncture surfaces, thus limiting the stresses applied to the mold wall sections during pouring of the ingot in the mold and solidification of the ingot, said predetermined preloading amount of force being determined by combining the total force of fluid static loading with the total forces for restricting free thermal deformation of the mold wall sections occurring during the pouring of molten metal into the mold in order to prevent leakage of molten metal from between the mold wall sections, said predetermined preloading being determined by the formula $$P = \frac{-3M_T w (x^2 + y^2)}{2.828\, l^3}$$

where P represents the approximate predetermined preloading force for the fastener assembly to restrict the free thermal deformation of the mold wall sections, $M_T$ is the thermal moment at the time generally coinciding with the filling of the mold cavity to a predetermined extent with molten metal and the formation of an ingot skin on a poured ingot, w is the width of the associated mold wall section, x and y are the coordinates of the outermost corner of the mold wall section, and l is the vertical distance between the uppermost and lowermost spring fastener assemblies on the mold, said free thermal deformation being determined by the formula $$W = \frac{-3M_T}{4Eh^3}(x^2 + y^2)$$

where W represents the thermal bending deformation of the associated mold wall section, $M_T$ is the thermal moment at the time generally coinciding with the filling of the mold cavity to a predetermined extent with molten metal and the formation of an ingot skin on a poured ingot having sufficient structural integrity to support the molten interior of the ingot, x and y are respectively the x and the y coordinates of the outermost corner of the mold wall section, E is the modulus of elasticity of the mold wall section, and h is the thickness of the mold wall section, said spring fastener assembly being adapted to provide an extent of yielding movement in response to loading beyond the preloaded condition due at least in part to increased thermal moment in the mold wall sections after formation of the ingot skin, that accommodates the thermal bending deformation of the mold wall sections as determined by the latter mentioned formula and where $M_T$ is now the increased thermal moment of the mold wall sections.

2. A pair of fastener assemblies in accordance with claim 1 wherein, certain of said sets of each said assembly being concave in one direction while the adjacent set is concave in the opposite direction, the concavities of said adjacent confronting sets facing one another, said confronting sets having flats at the engaging peripheries thereof enabling the stability of said spring sets on said elongated member to be enhanced during precompression and subsequent further compression thereof upon pouring of the mold.

3. A pair of fastener assemblies in accordance with claim 2 wherein said disc springs of each said assembly are of varying size.

4. A pair of fastener assemblies in accordance with claim 2 wherein said disc springs of each said assembly require between approximately 75,000 to 100,000 pounds force to flatten each respective spring, and wherein certain of said springs of each said assembly are of approximately seven inch diameter and other of said springs of each said assembly are of approximately twelve inch diameter.

5. A pair of fastener assemblies in accordance with claim 2 wherein said elongated tie member is formed of high strength steel of aircraft quality, said means on said tie member end for adjusting the effective length thereof comprising a threaded section on said member end and a coacting nut.

6. A pair of fastener assemblies in accordance with claim 3 which includes washer means coacting with said tie member and with said disc springs of each said assembly for providing a generally flat abutment for said assembly.

* * * * *